United States Patent [19]

Alexander et al.

[11] 3,987,721

[45] Oct. 26, 1976

[54] APPARATUS FOR MANUFACTURING AUTOMOBILE LICENSE PLATES

[75] Inventors: Donald R. Alexander, Conway, Ark.; Carl W. Johnson, Neenah, Wis.

[73] Assignee: Donald R. Alexander, Conway, Ark.

[22] Filed: Apr. 17, 1974

[21] Appl. No.: 461,721

[52] U.S. Cl. ..... 101/18; 72/405; 101/19

[51] Int. Cl.[2] ..... B21J 9/02; B21J 9/20

[58] Field of Search ..... 101/18, 19; 72/405, 72/324, 339

[56] References Cited

UNITED STATES PATENTS

| | | | |
|---|---|---|---|
| 1,407,769 | 2/1922 | Premo | 101/18 |
| 3,722,252 | 3/1973 | Marantette | 72/405 X |
| 3,807,215 | 4/1974 | Olsen et al. | 72/405 |
| 3,815,403 | 6/1974 | Daniels | 72/405 |
| 3,824,921 | 7/1974 | Alexander | 101/119 |
| 3,901,143 | 8/1975 | Alexander et al. | 101/18 |

*Primary Examiner*—Edgar S. Burr
*Assistant Examiner*—R. E. Suter
*Attorney, Agent, or Firm*—James E. Nilles

[57] ABSTRACT

Apparatus for manufacturing discrete embossed consecutively numbered license plates from a continuous length of web or strip of sheet metal comprises a hole punching press, an embossing press, a rimming press, and a blanking press, all of which operate in unison. A feed conveyor is located between the rimming and blanking presses to advance the web in steps through the entire series of presses. The movable platen of the embossing press cooperates with a numerical registering device having an assembly of relatively rotatable decimal rings and each ring has a series of embossed numbers on its obverse side and a corresponding number of holes on its converse side. The registering device also comprises an indexing mechanism to advance the rings in desired sequences and the indexing mechanism comprises a motor driven oscillatory indexing arm movable through a counting stroke to advance one or more rings one step and a return stroke. The indexing arm carries four pneumatically actuated clutch units, each having a clutch pin selectively extendable to engage the pin hole on its associated ring to advance that ring. The indexing mechanism further comprises four stationarily mounted pneumatically actuated lock pin units, each having a lock pin selectively extendable to engage the pin hole on its associated ring to lock the ring until the next advance is required. Appropriate control means are provided.

6 Claims, 47 Drawing Figures

I6
DL1+
R9
R12
R27
PB6
R10
R11
6CS
9SS
R16
R18
R17
R19
R20
CR3
CR4
CR4A
G11
R21
R40
R22
R29
8SS
MCR 4
R30
TO PB12
21LSA
CR3A
CR2
CR2A
8CS
7CS
24LS
7SS
CR2-2
R15
CR1
CR1A
23LS
3SS
MCR1
R14
R1
R28
9LS
6SS
MCR3
R13
6CS
R7
PB5
22LS
21LS
11LS
PB7
1SS
R6
4SS
MCR2
R3
TO 71X
PB4
R5
R4
10LS
CR3 1
R29
TO 102
CR1-1
3CS
8LS
55X
DL2
DL1
CR1TD-1X
BR
T2
AL1
AL2
RIMMING PRESS
R14
15X
PB9
16X

BLANKING PRESS
R16
3X
PB7
16X

EMBOSSING PRESS
R13
15X
PB10
25LS
16X

PUNCH PRESS
R15
3X
PB8
16X

APPARATUS FOR MANUFACTURING AUTOMOBILE LICENSE PLATES

BACKGROUND OF THE INVENTION

FIELD OF USE

This invention relates generally to apparatus for manufacturing discrete embossed consecutively numbered elements, such as automobile license plates, from a continuous web or strip of material such as sheet metal.

CROSS-REFERENCE TO RELATED APPLICATIONS

This application relates to our copending U.S. patent applications "NUMERICAL REGISTERING DEVICE", Ser. No. 461,645 and "EMBOSSING PRESS", Ser. No. 461,646 both filed in the U.S. patent office on the same date as our present application. Applications Ser. No. 461,645 issued as U.S. Pat. No. 3,874,585 on Apr. 1, 1975. Application Ser. No. 461,646 which will issue as U.S. Pat. No. 3,901,143 on Aug. 26, 1975.

DESCRIPTION OF THE PRIOR ART

In some known types of apparatus of the aforementioned character, a single custom-made machine is provided to operate upon a sheet metal web advancing therethrough to perform the steps necessary to provide a license plate blank ready for finishing and painting, etc. Such steps include, for example, those of advancing the web through the machine, punching necessary holes and slots, embossing background information and designs, embossing consecutive numerals, and cutting off the finished blank. U.S. patent application Ser. No. 296,602 for "Serial Number Embossing Apparatus" filed Oct. 11, 1972 by Donald R. Alexander, and which issued as U.S. Pat. No. 3,824,921 on July 23, 1974 discloses such apparatus. In some prior art apparatus, two or more of the above-mentioned steps are combined in a single operation and may be performed in an order different from that listed. In any event, such prior art apparatus tended to be relatively complex and costly to build and involved such an interdependence and interaction of parts, timing and operating sequences that a minor failure anywhere in the apparatus rendered the entire apparatus inoperative.

SUMMARY OF THE INVENTION

Apparatus in accordance with the invention for making discrete embossed consecutively numbered segments or elements, such as automobile license plates, from a continuous web or strip of material, such as sheet metal, comprises a punching press including a movable platen for punching mounting holes in the web; an embossing press including a movable platen and an associated numerical registering device including a indexing mechanism having an assembly of relatively rotatable rings, each of which rings has a series of embossing elements (i.e., numerals 0 through 9) on the obverse side thereof and a series of pin engaging means, such as pin holes, on the converse side; a rimming press including a movable platen for forming a rim around the edge of the plate; and desired legends, as well as indexing holes for web advancement; a blanking press including a movable platen for severing embossed segments from said web; a feed conveyor located between the rimming and blanking presses for engaging the indexing holes to draw or pull the web in stages or steps through the presses; and a discharge conveyor.

The indexing mechanism further comprises an indexing arm swingable through a counting or ring advance stroke and return stroke and also comprises pneumatically actuated clutch units mounted on the indexing arm, each of said clutch units having a clutch pin selectively extendable to engage a pin hole and to rotate or advance an associated ring to achieve ring advance in a predetermined order at successive intervals of time.

The indexing mechanism further comprises pneumatically actuated lock units having lock pins mounted on the indexing mechanism frame, which lock pins are selectively extendable to engage the pin holes to prevent rotation or advance of an associated ring.

The apparatus also comprises control means which are operable in the automatic or manual modes, including a rotating cam switch assembly having cam operated switches operable in the automatic mode and responsive to the position of the indexing arm to effect simultaneous operation of the four presses during intervals of time when the web and all rings are stationary; to effect extension of the appropriate clutch pins and retraction of the appropriate lock pins as the indexing arm moves through its count or advance stroke to enable advance movement of an appropriate ring or rings and to effect retraction of the appropriate clutch pins to enable the indexing arm to return and to effect extension of the appropriate lock pins to lock the rings as the indexing arm moves through its return stroke; and to effect operation of the feed conveyor to move the web during intervals of time while any of said rings is being advanced and while the presses are open.

The control means also includes limit switches on the presses responsive to platen position to prevent the cam switches from effecting operation of the presses and feed conveyor until all of said platens are in a predetermined operating position. The control means also includes limit switches responsive to the position of the clutch and lock pins to prevent the cam switches from effecting operation of the clutch and lock units, the presses and the feed conveyor until all pins are in a predetermined operating position. The control means also includes counting switch actuator means on each of said rings and counting switches on the indexing mechanism frame responsive to ring position and operable when the control means are in automatic mode to effect rotation of the rings in a predetermined sequence. The control means further comprises manually operable pushbutton switches operable when the control means are in the manual mode to effect advance of each ring individually.

Apparatus in accordance with the invention affords numerous advantages over prior art apparatus. For example, the four presses are commercially available units which can be readily replaced in the event one becomes inoperative, thereby reducing downtime of the entire apparatus. Furthermore, location of the feed conveyor between the rimming and blanking press enables the web to be drawn or pulled from its reel through the first three presses, rather than being pushed as in prior art systems, thereby avoiding the problem of web bucking or jamming. The numerical registering device can be drawn clear of its associated embossing press for convenience in set-up, adjustment and service. Certain operating relationships between system components, such as the registering device, the presses and the conveyors, are carried out or maintained by electrical contactors, relays and limit switches in an electrical control system rather than by direct mechanical connections and, consequently, accidental operation of one component cannot physically force operation of another component which is not in condition for proper operation. Furthermore, since each major component of the apparatus is an individual element not physically connected to another, it is possible to attain higher operational speeds (such as up to 80 operations perminute) and higher production rates because inertial forces during various operational steps are not cumulative and are, therefore, reduced.

These and other objects and advantages of the present invention will appear hereinafter as this disclosure progresses, reference being had to the accompanying drawings.

DRAWINGS

Figure 1:
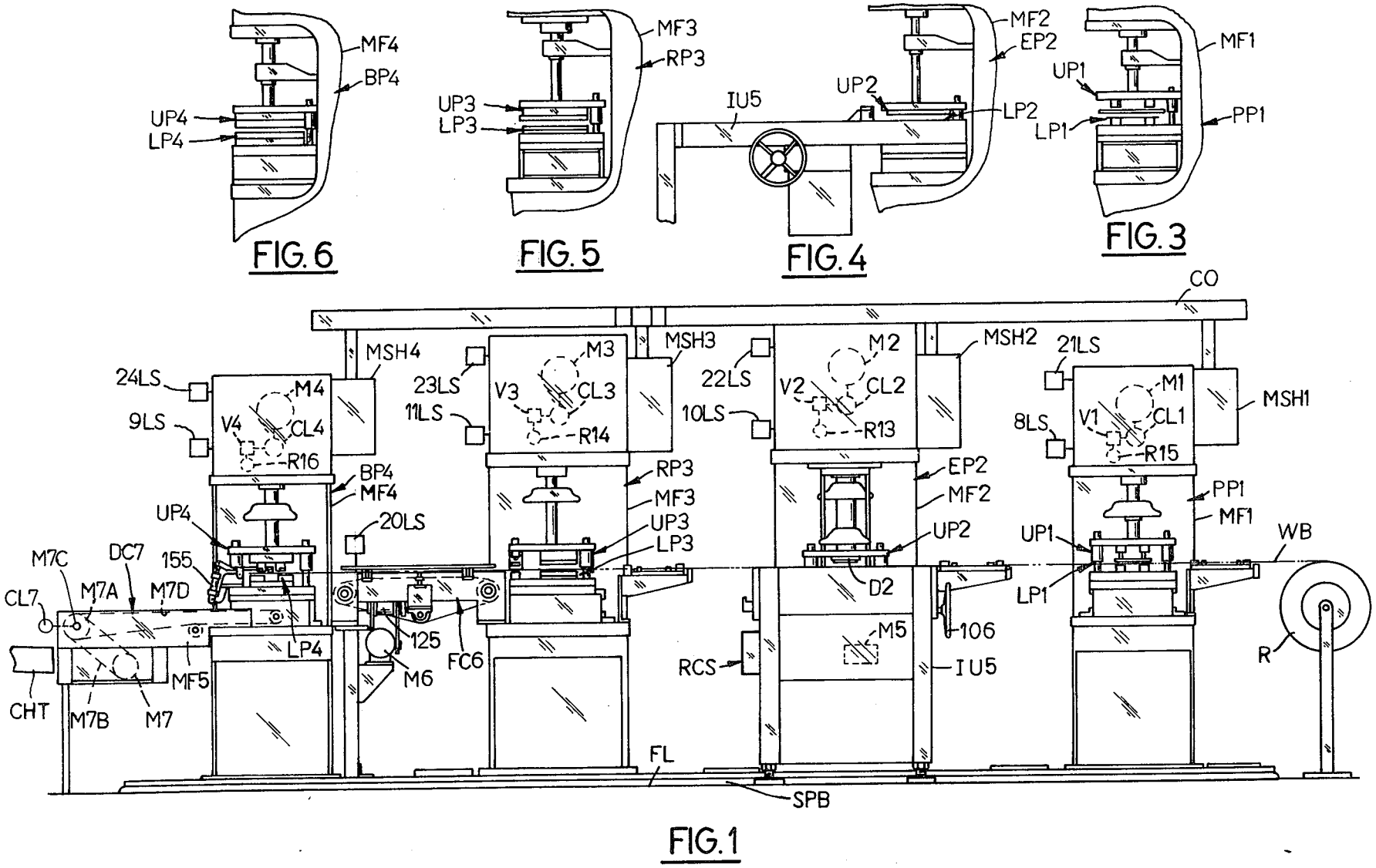
FIG. 1 is a front elevational view of apparatus in accordance with the invention and generally comprising (from right to left) a roll of sheet material, a punching press, an embossing press with a numerical registering device disposed thereinfront, a rimming press, a feed conveyor, a blanking press, and a discharge conveyor.
Figure 7:
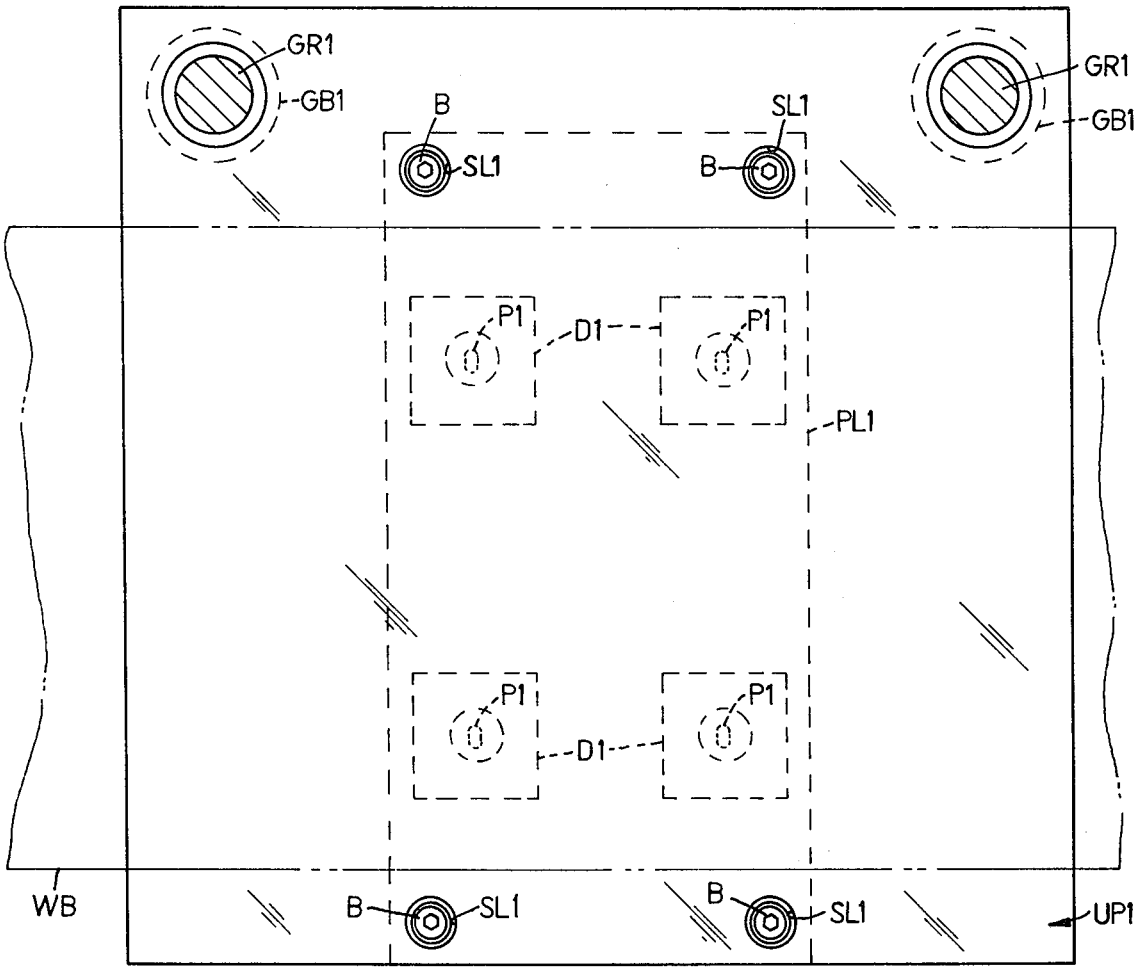
Figure 8:
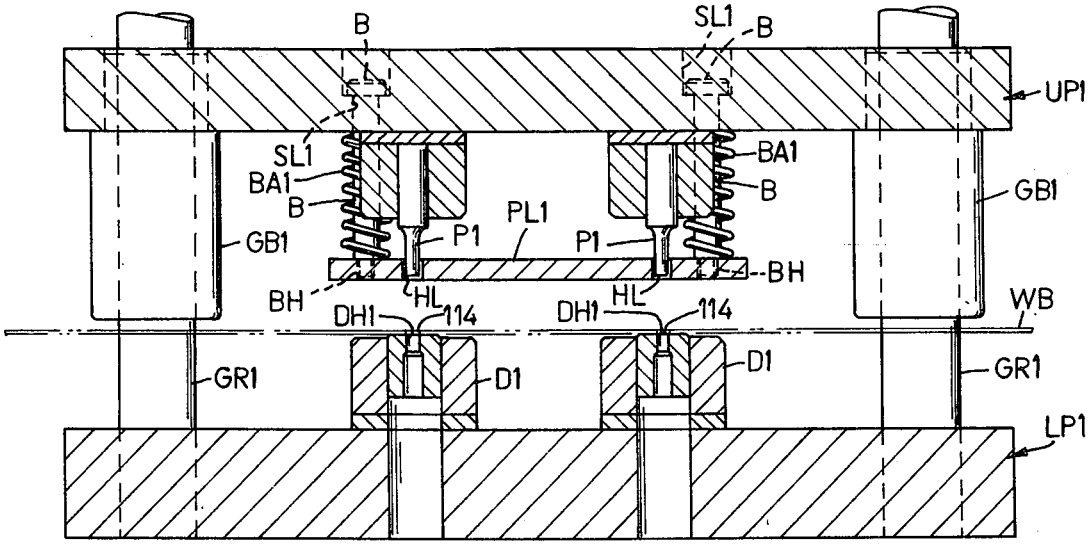
Figure 9:
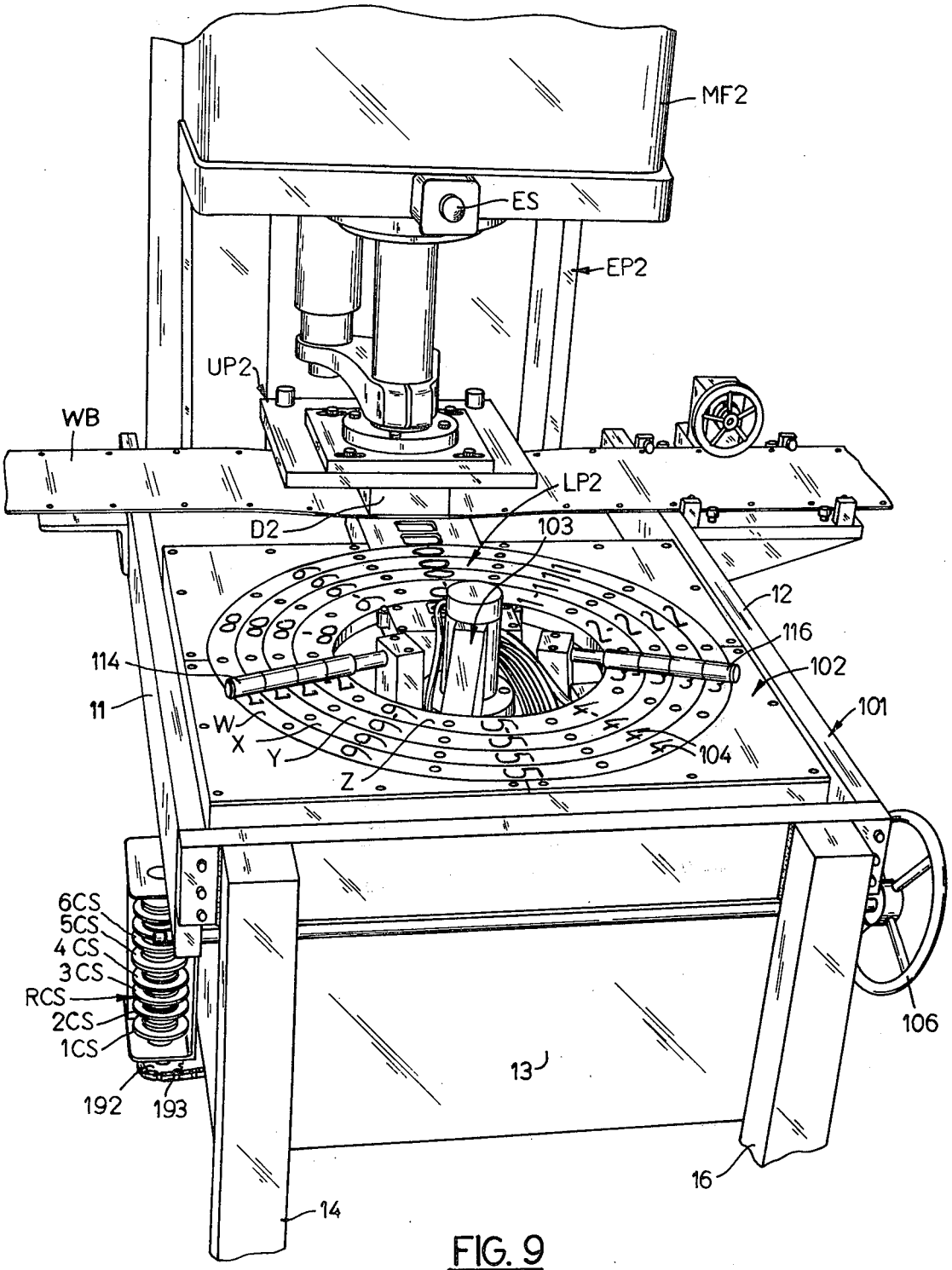
Figure 10:
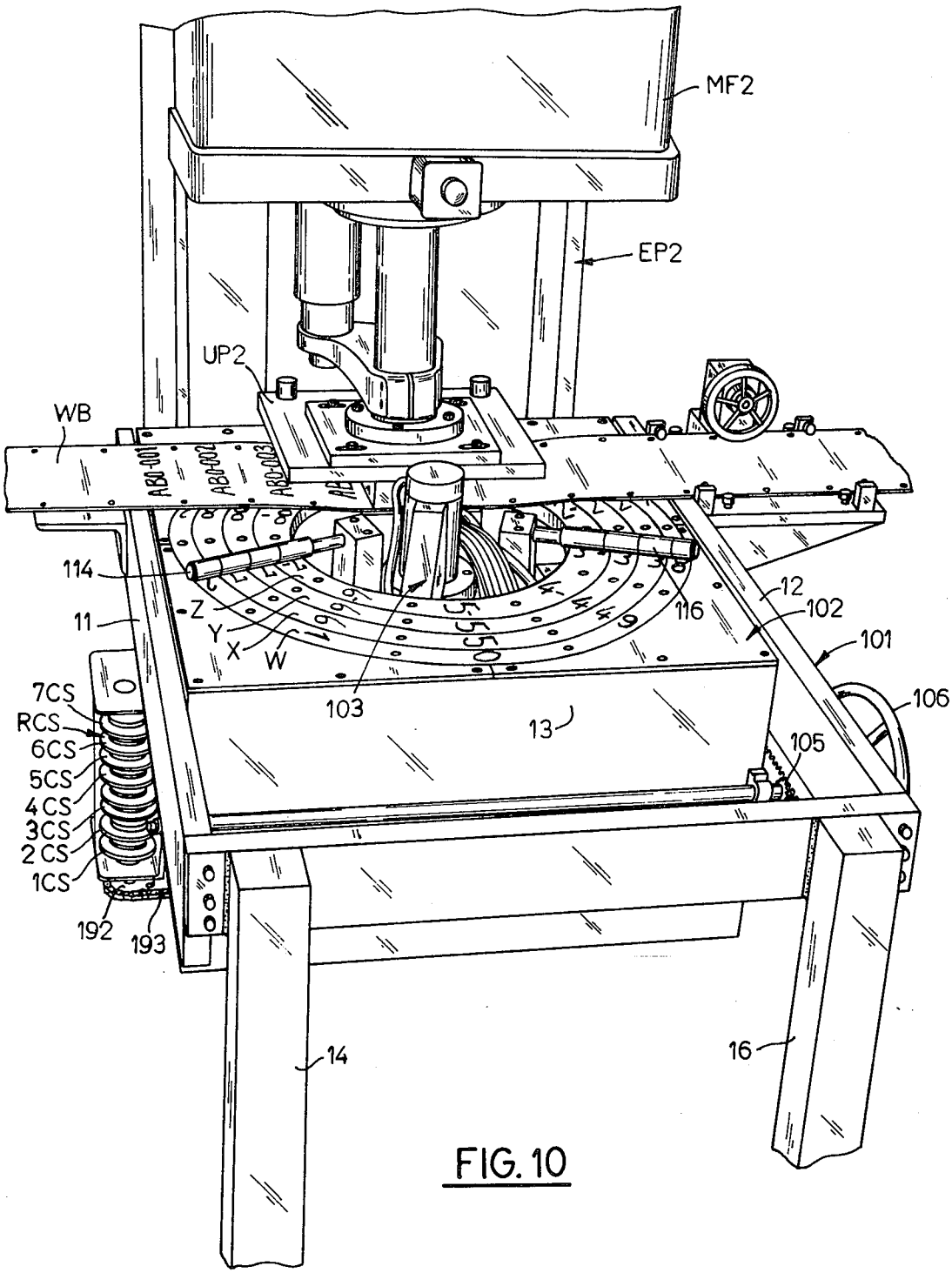
Figure 11:
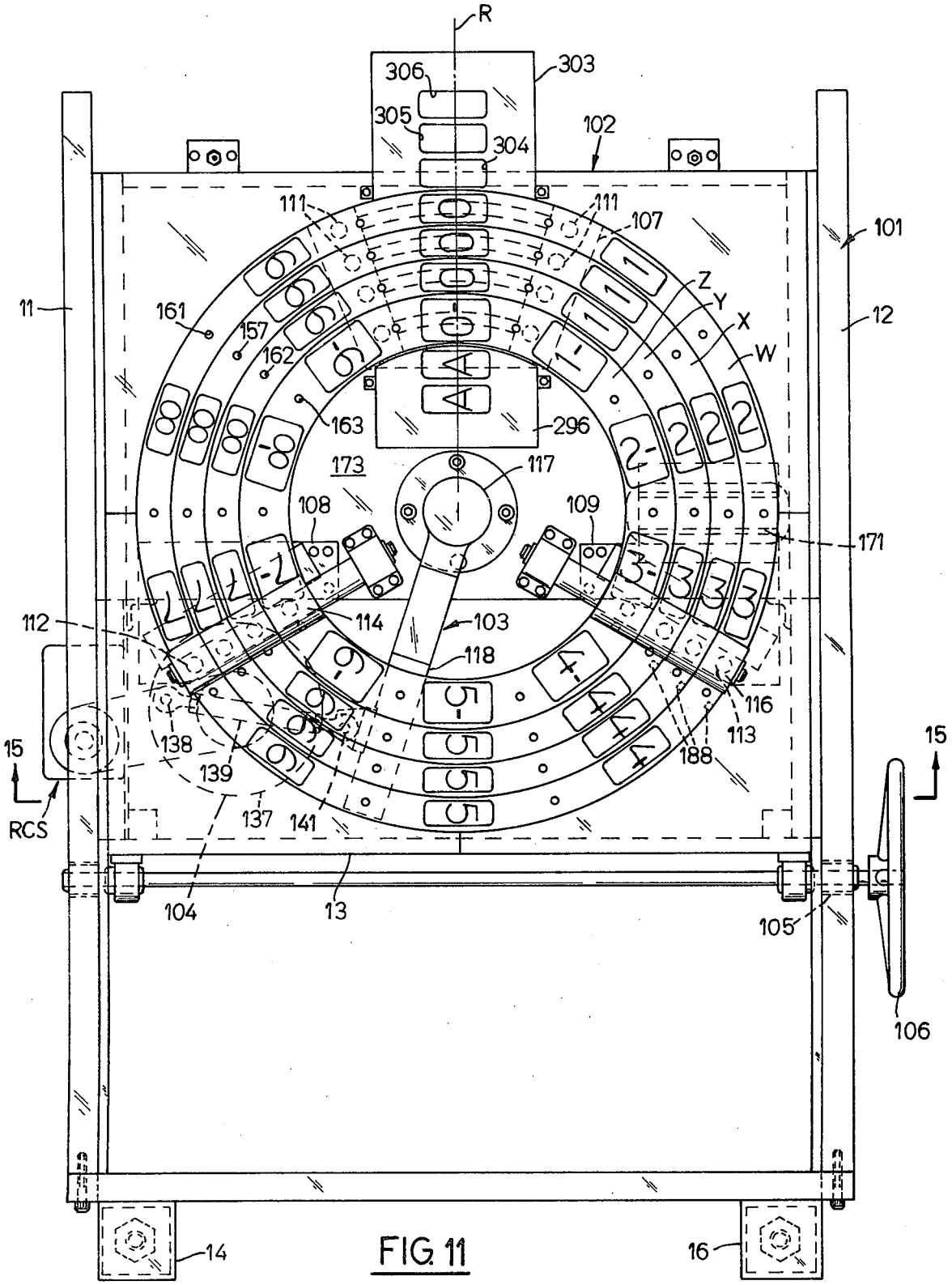
Figure 12:
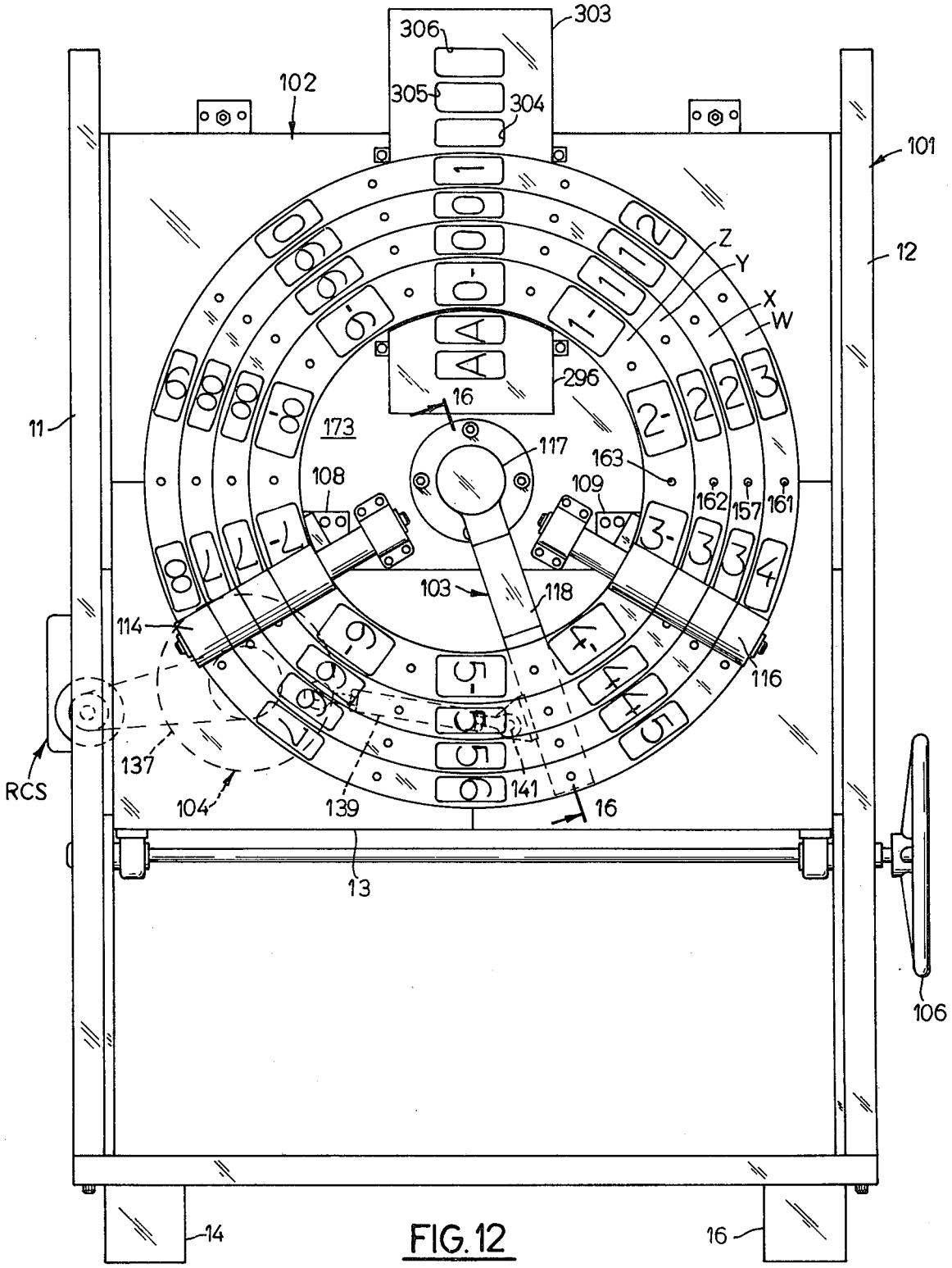
Figure 13:
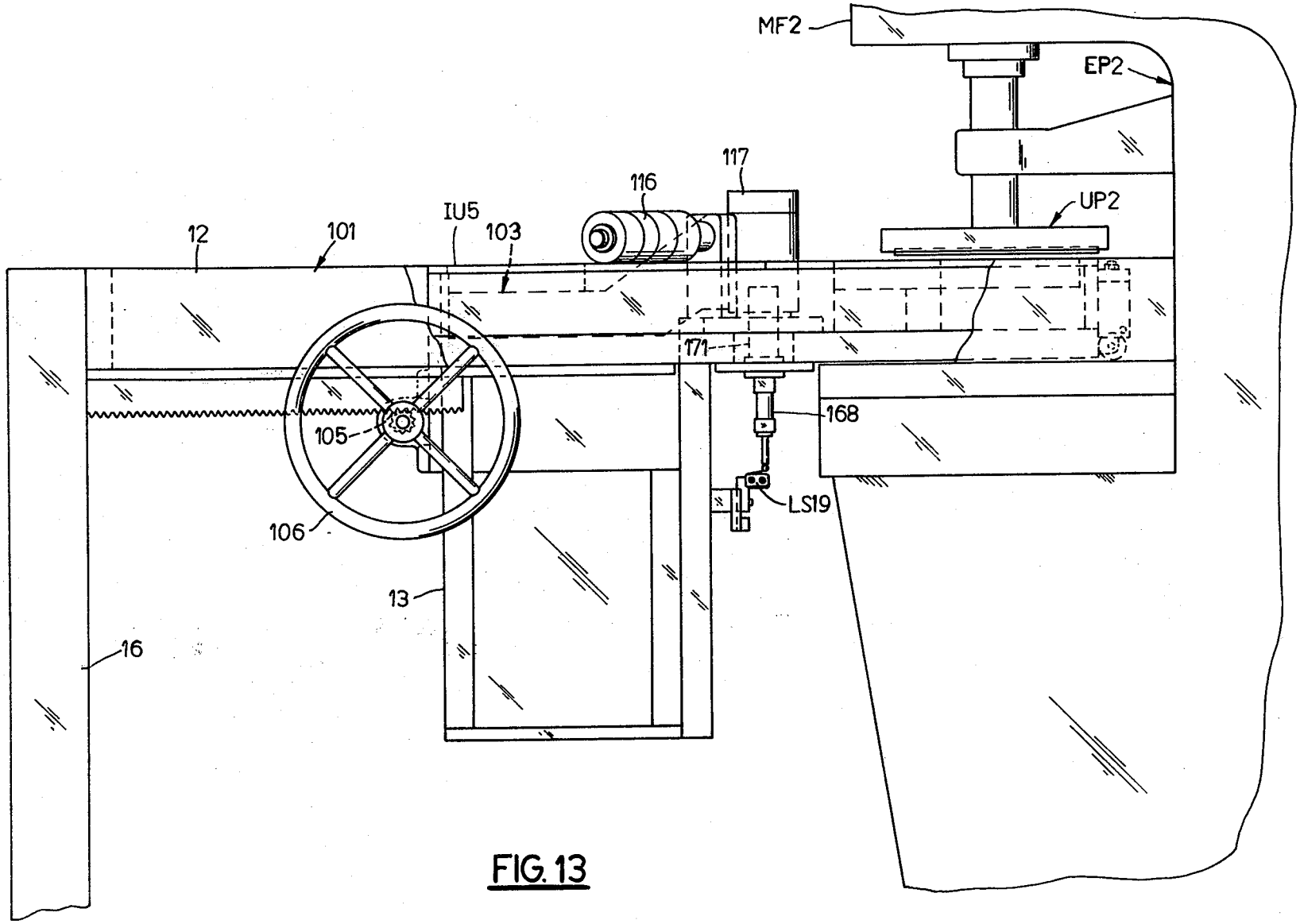
Figure 14:
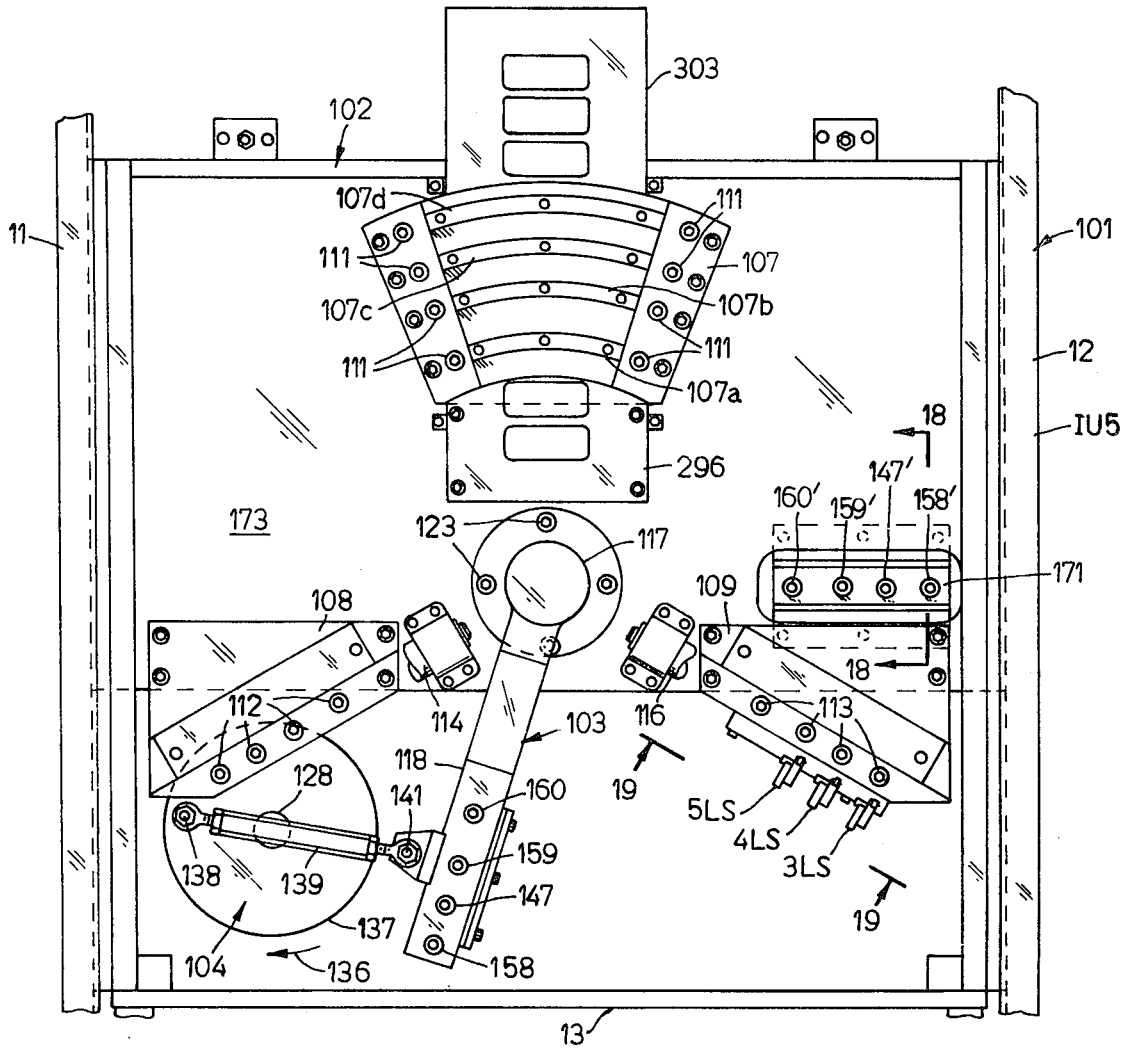
Figure 15:
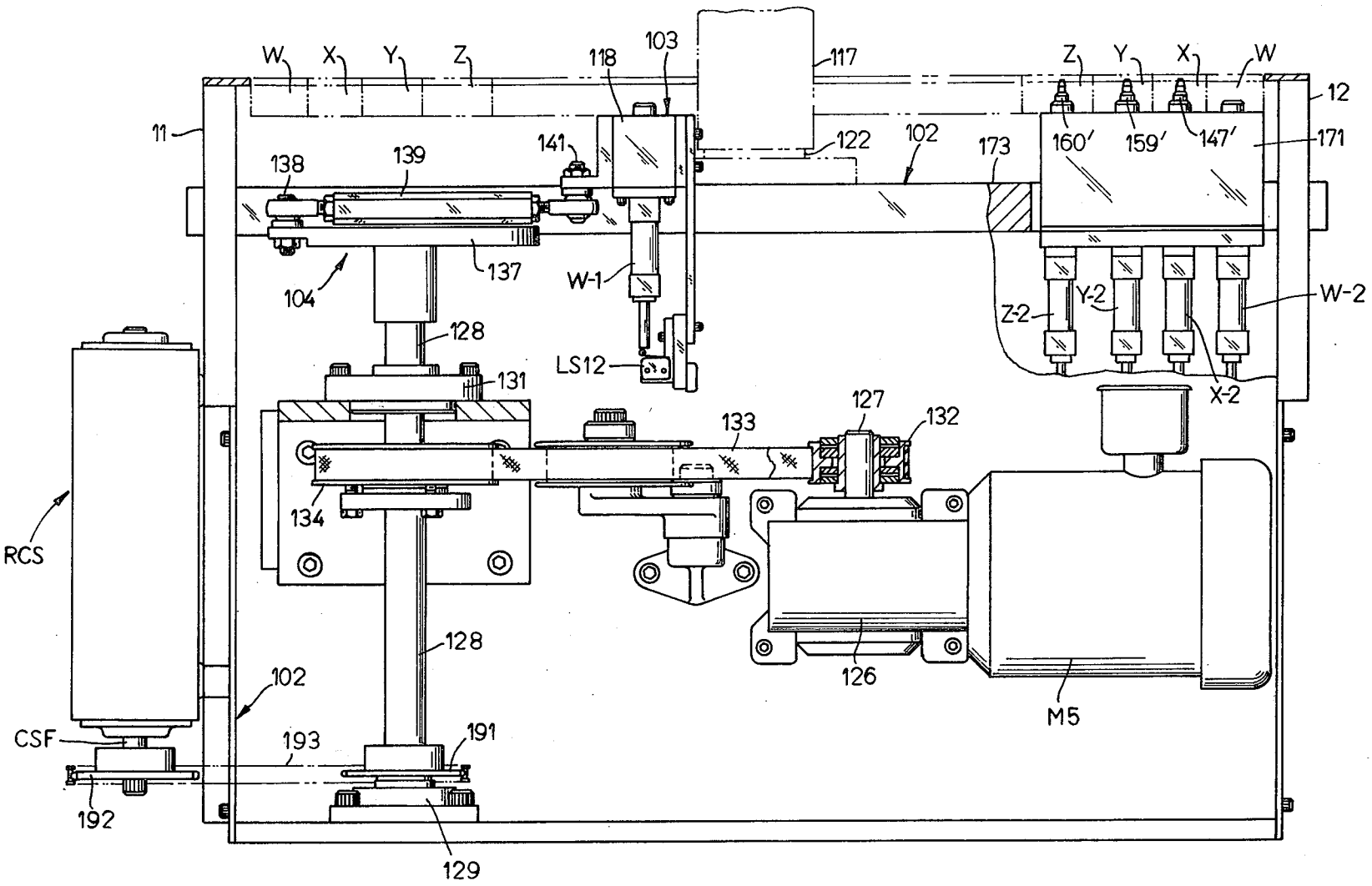
Figures 16, 17:
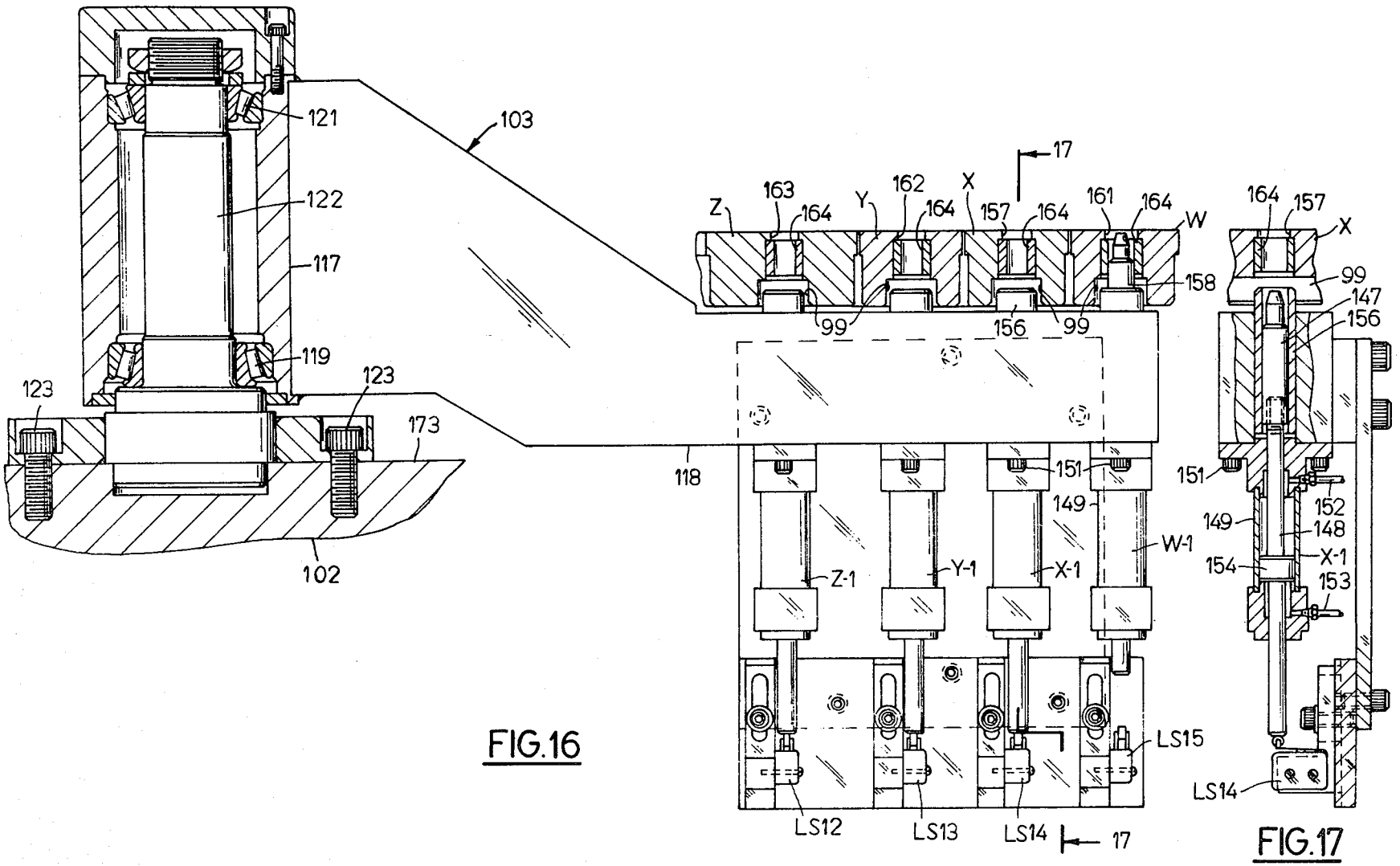
Figure 19:
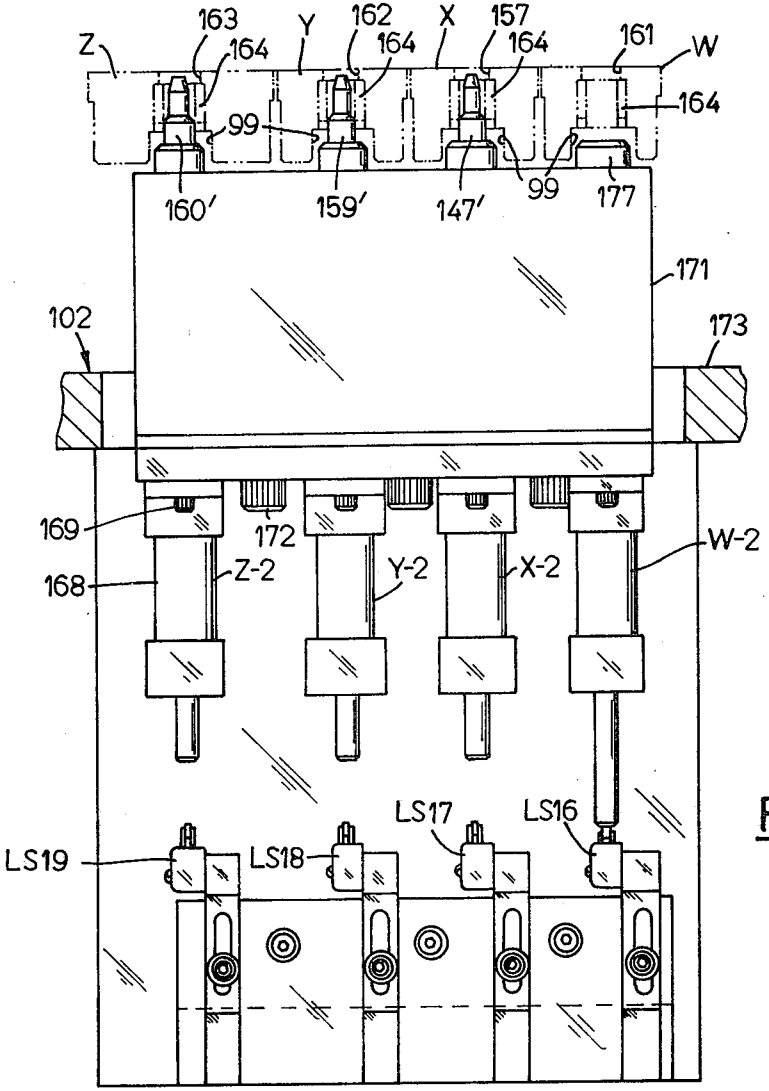
Figure 18:
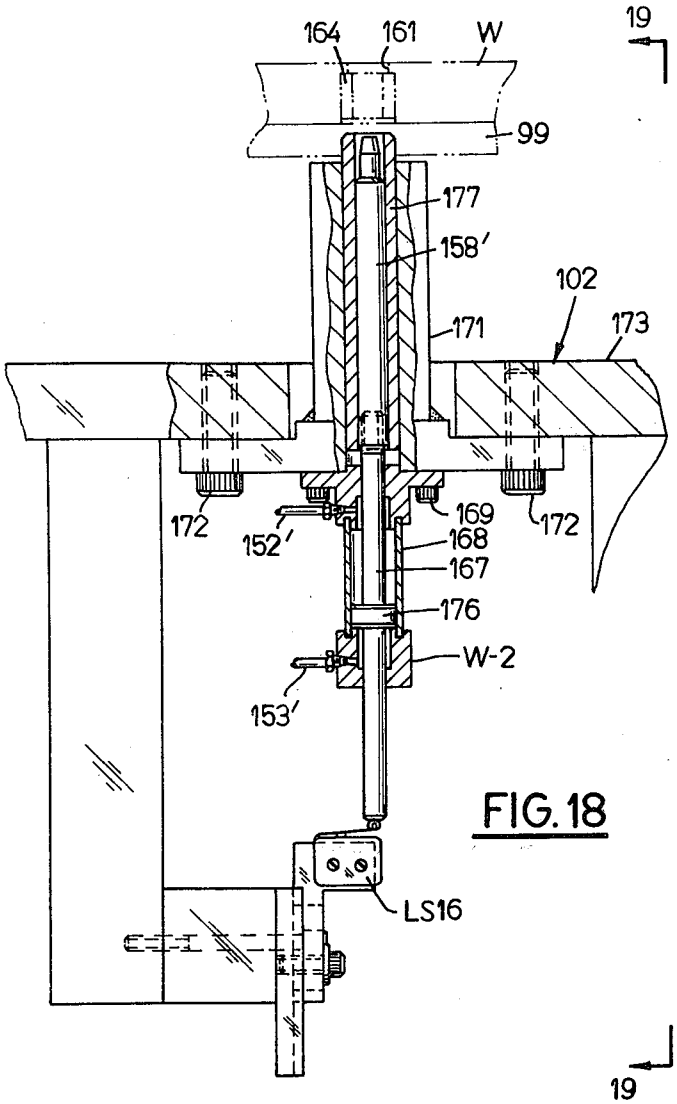
Figure 20:
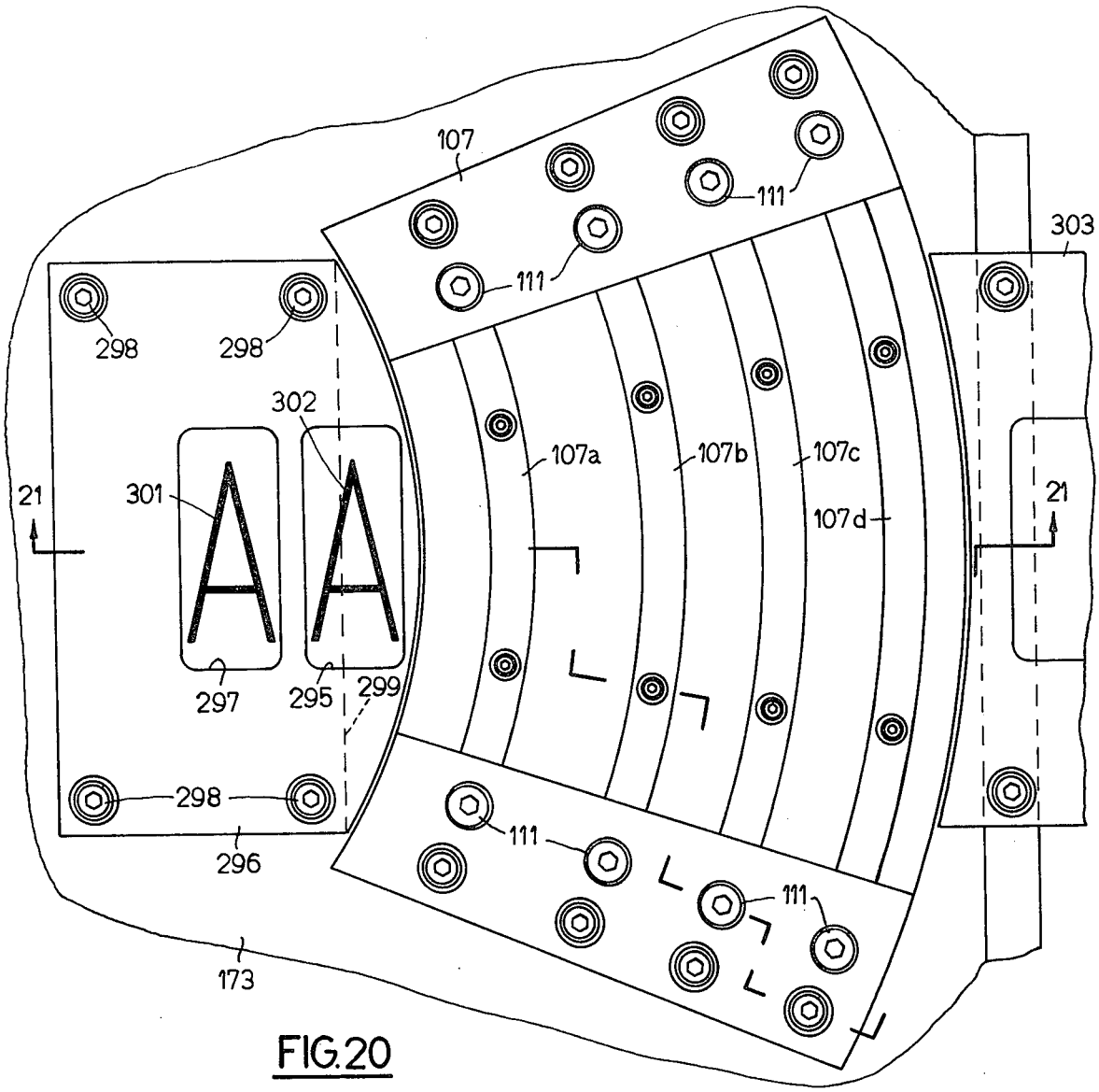
Figure 21:
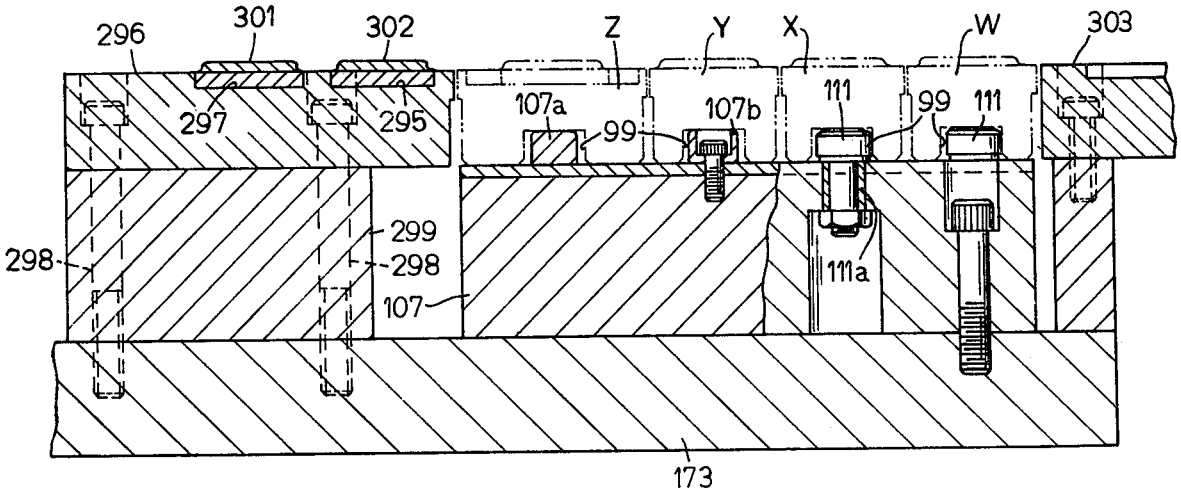
Figure 22:
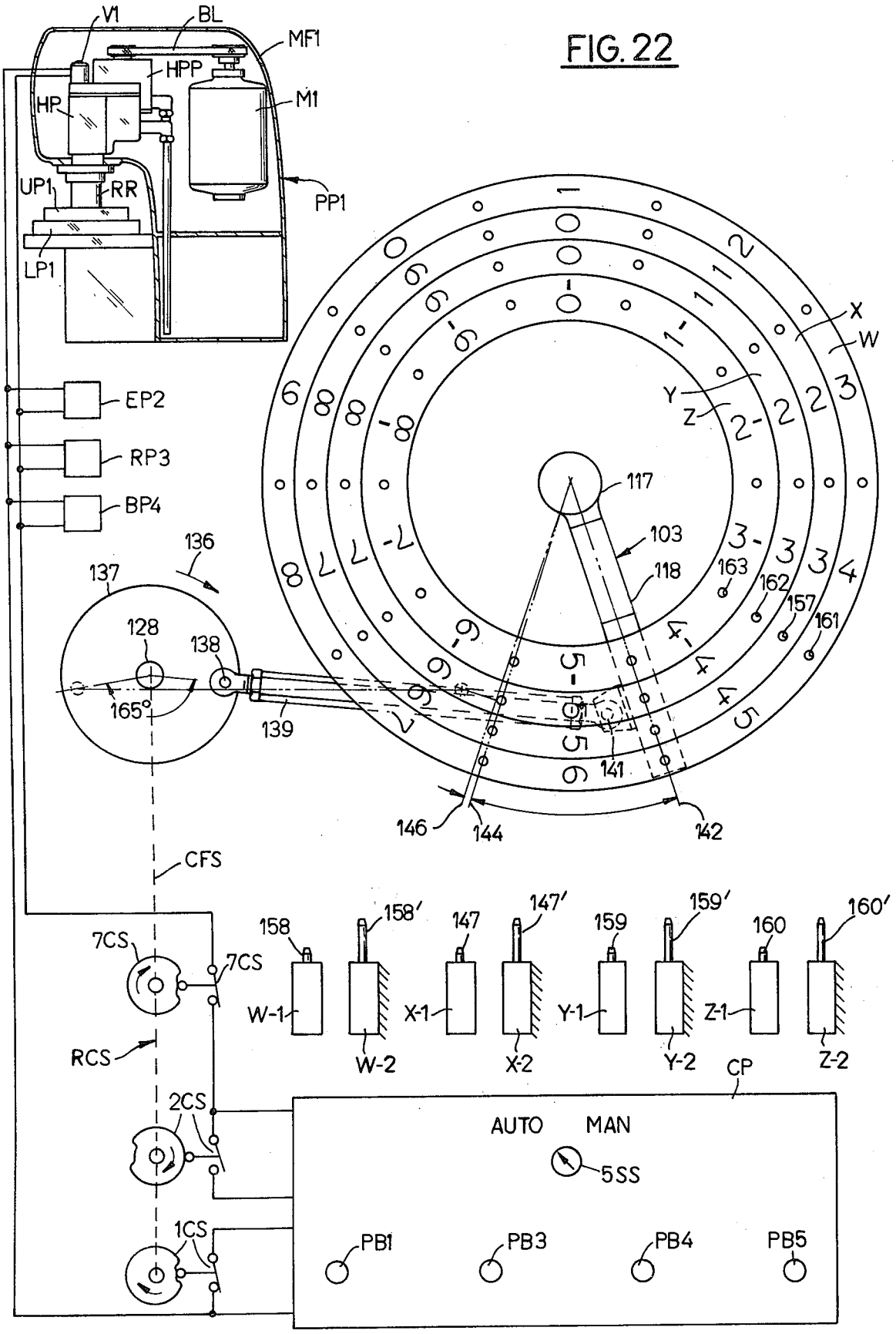
Figure 23:
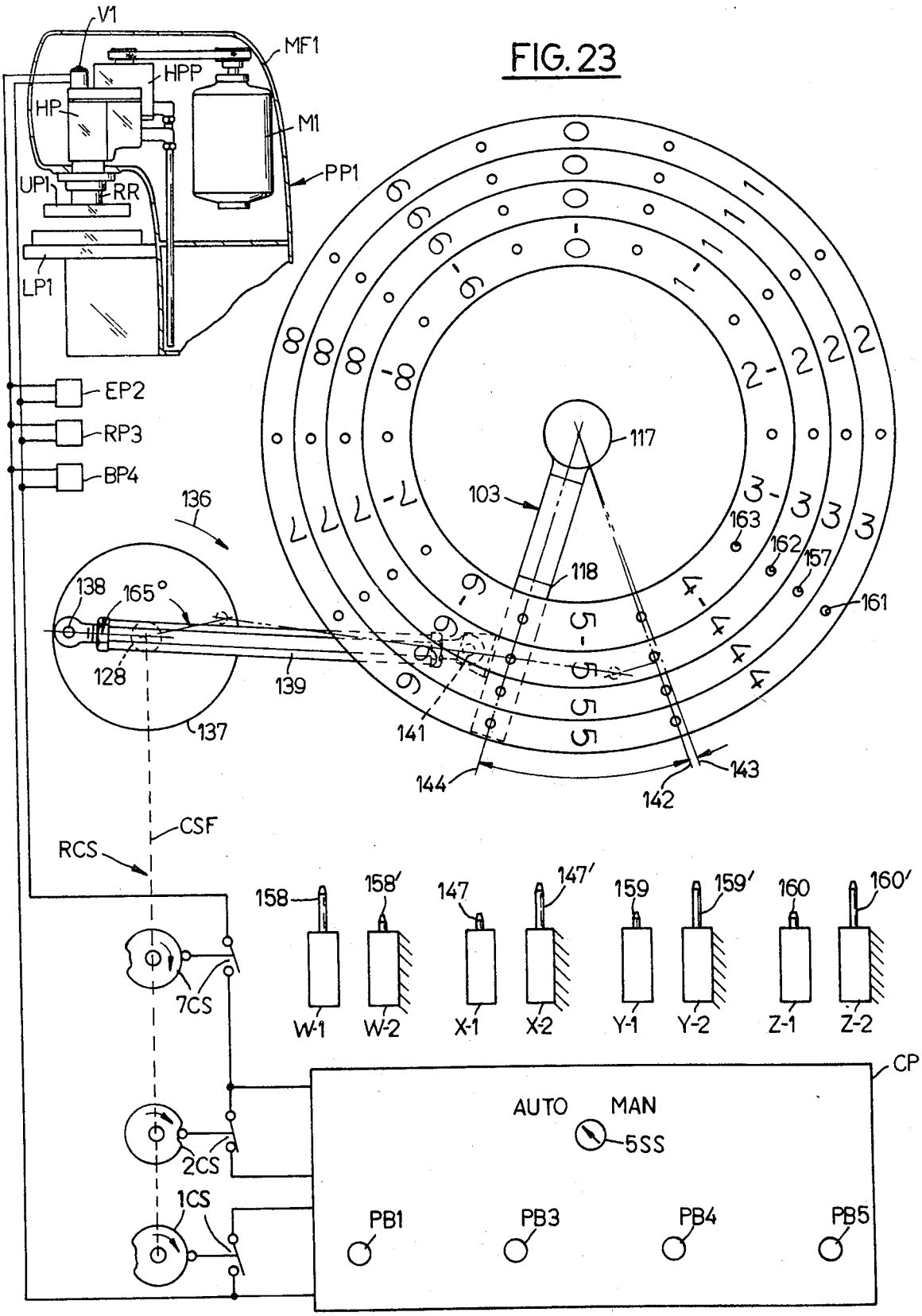
Figure 24:
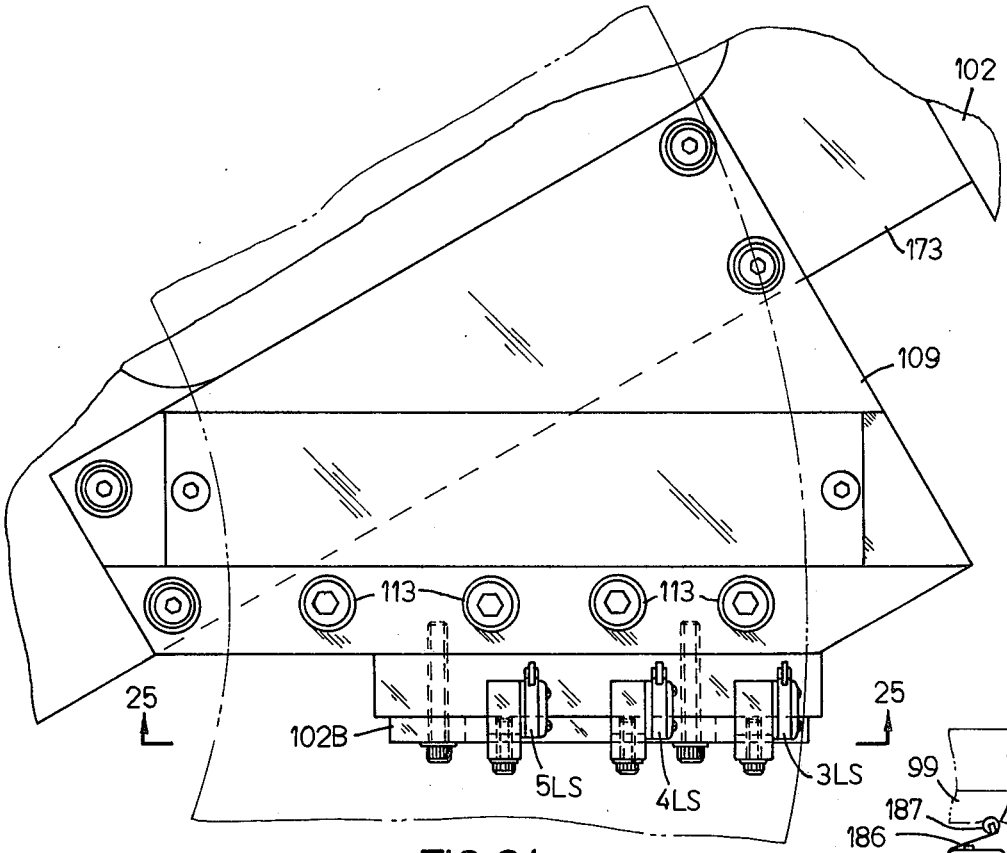
Figure 26:
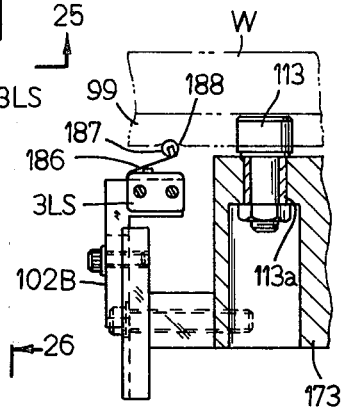
Figure 25:
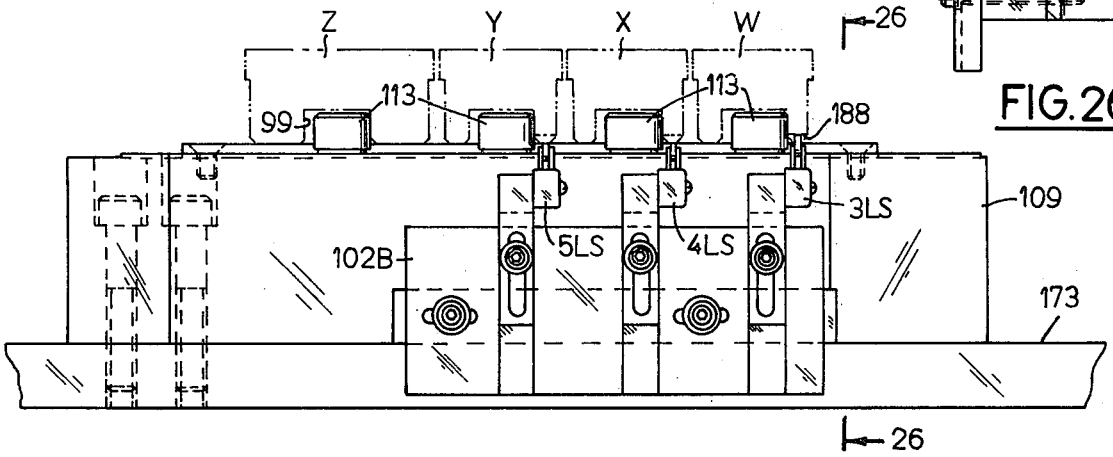
Figure 27:
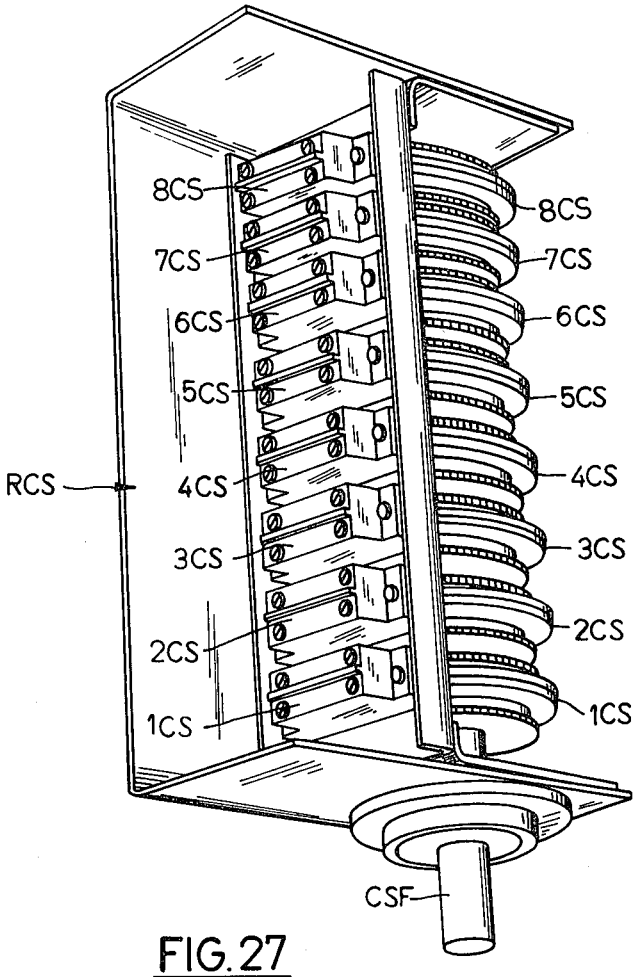
Figure 28:
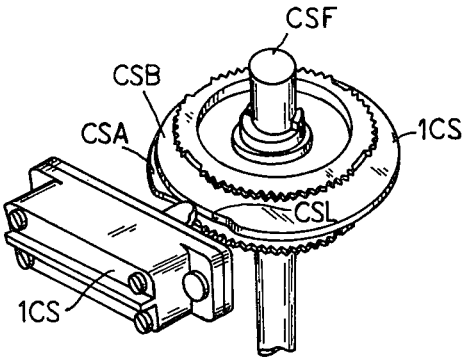
Figure 29:
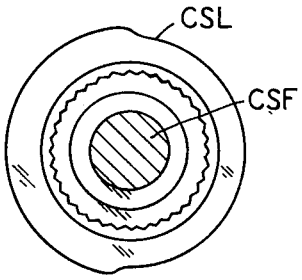
Figure 30:
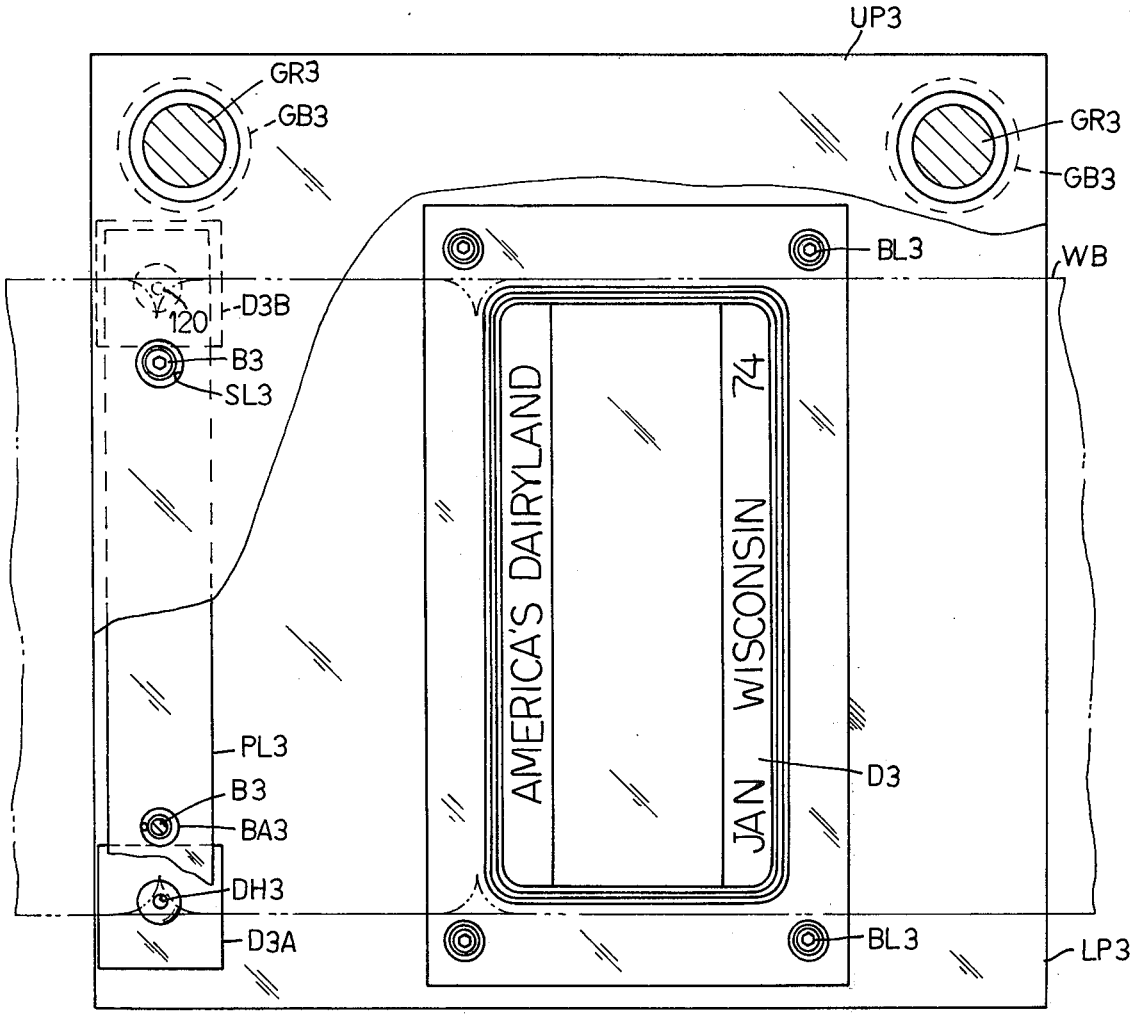
Figure 31:
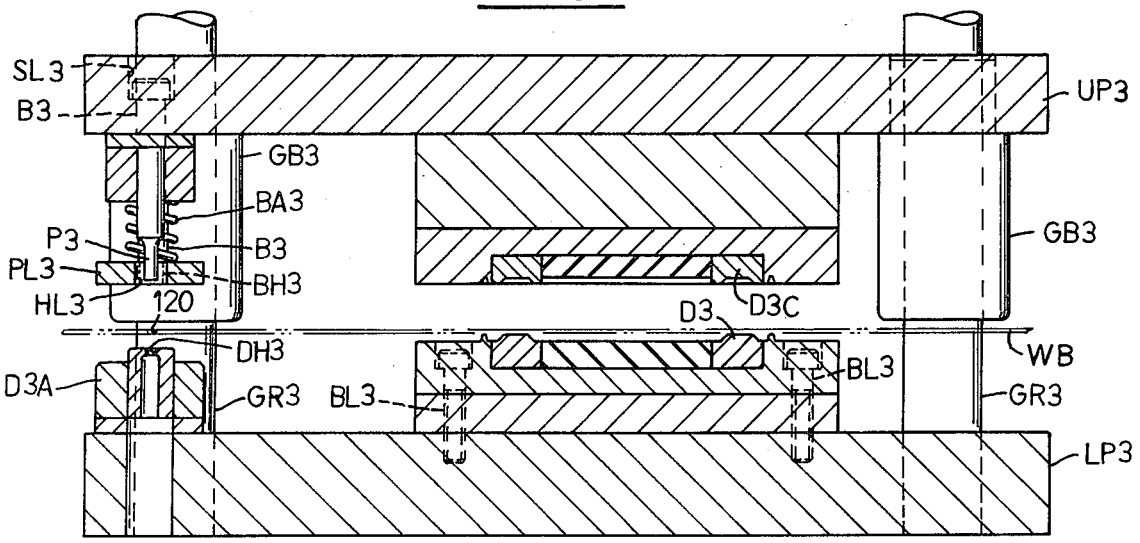
Figure 32:
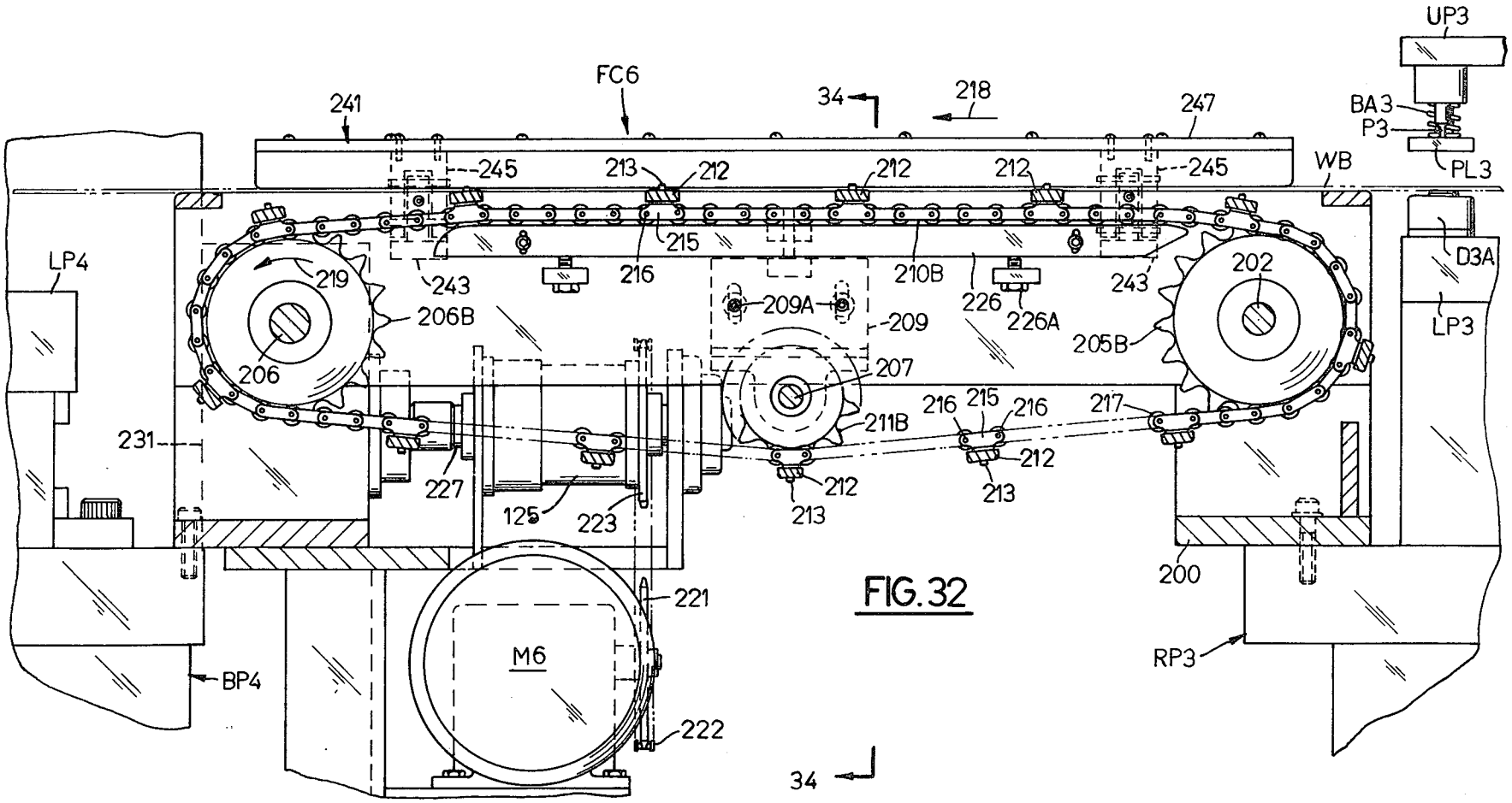
Figure 33:
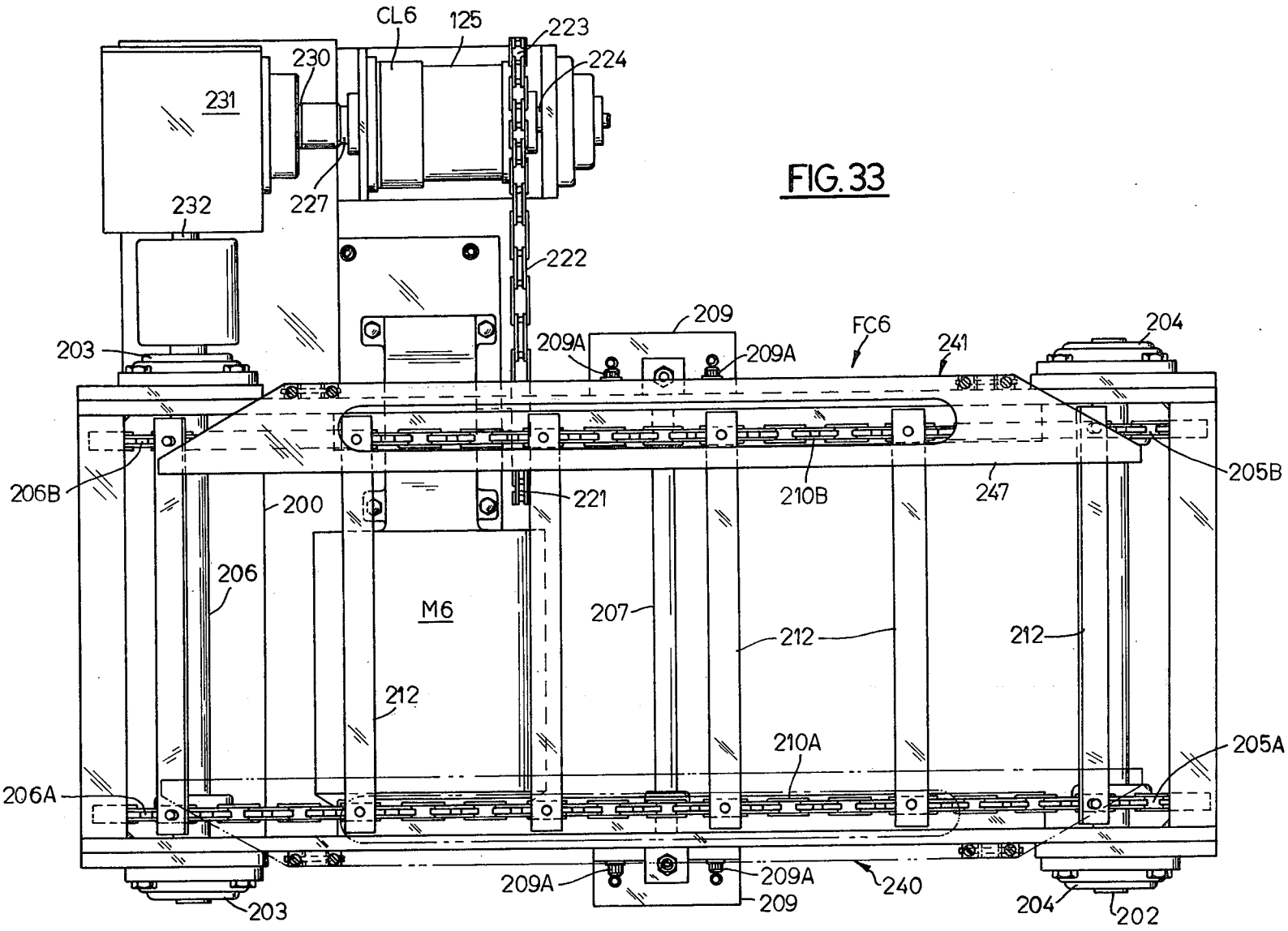
Figure 34:
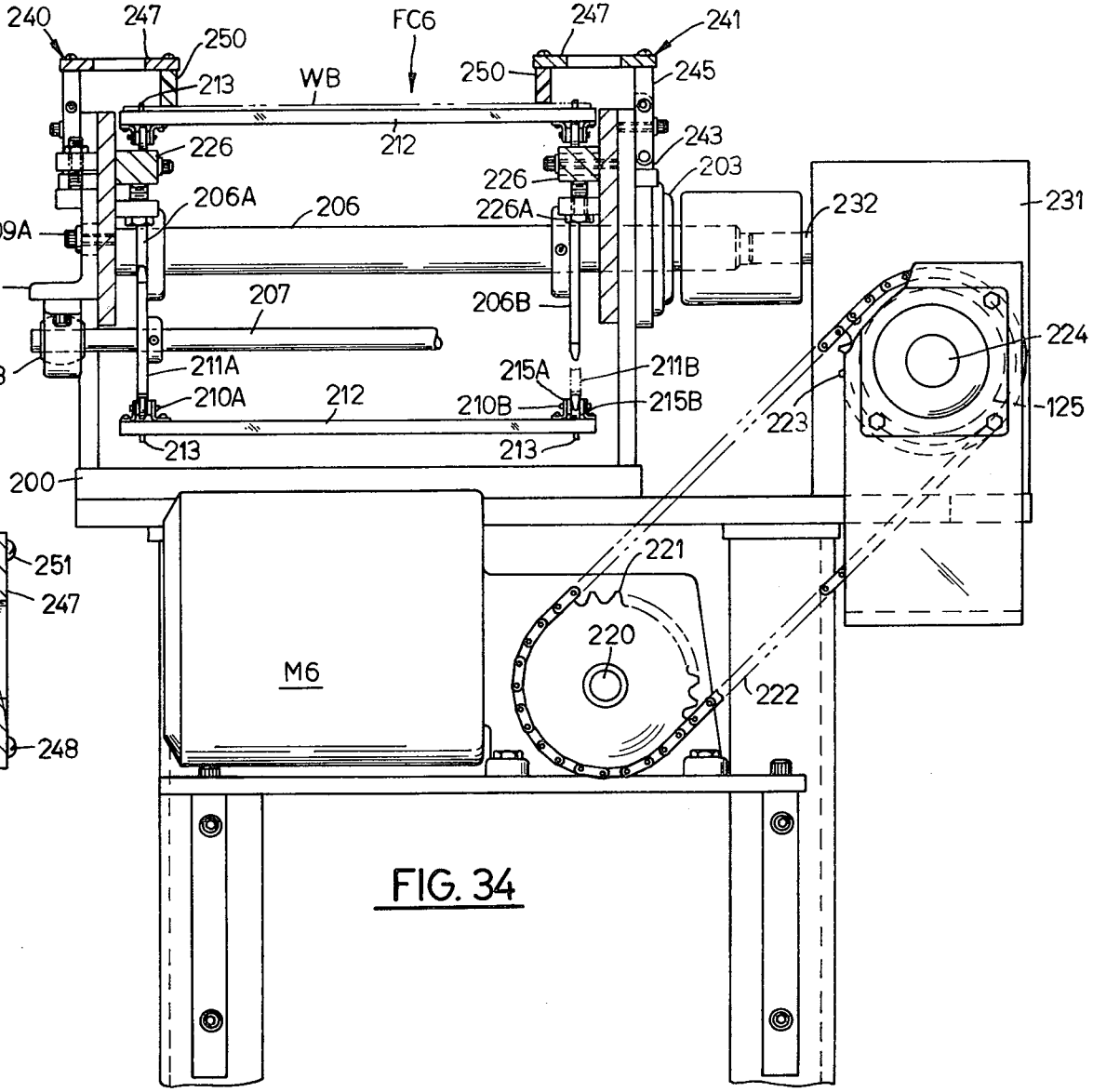
Figure 35:
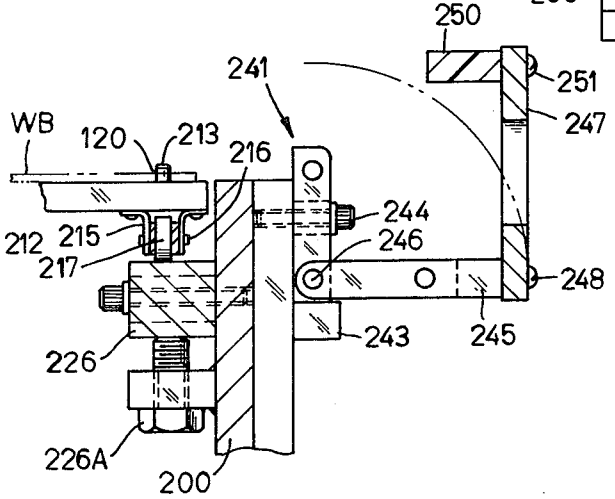
Figure 36:
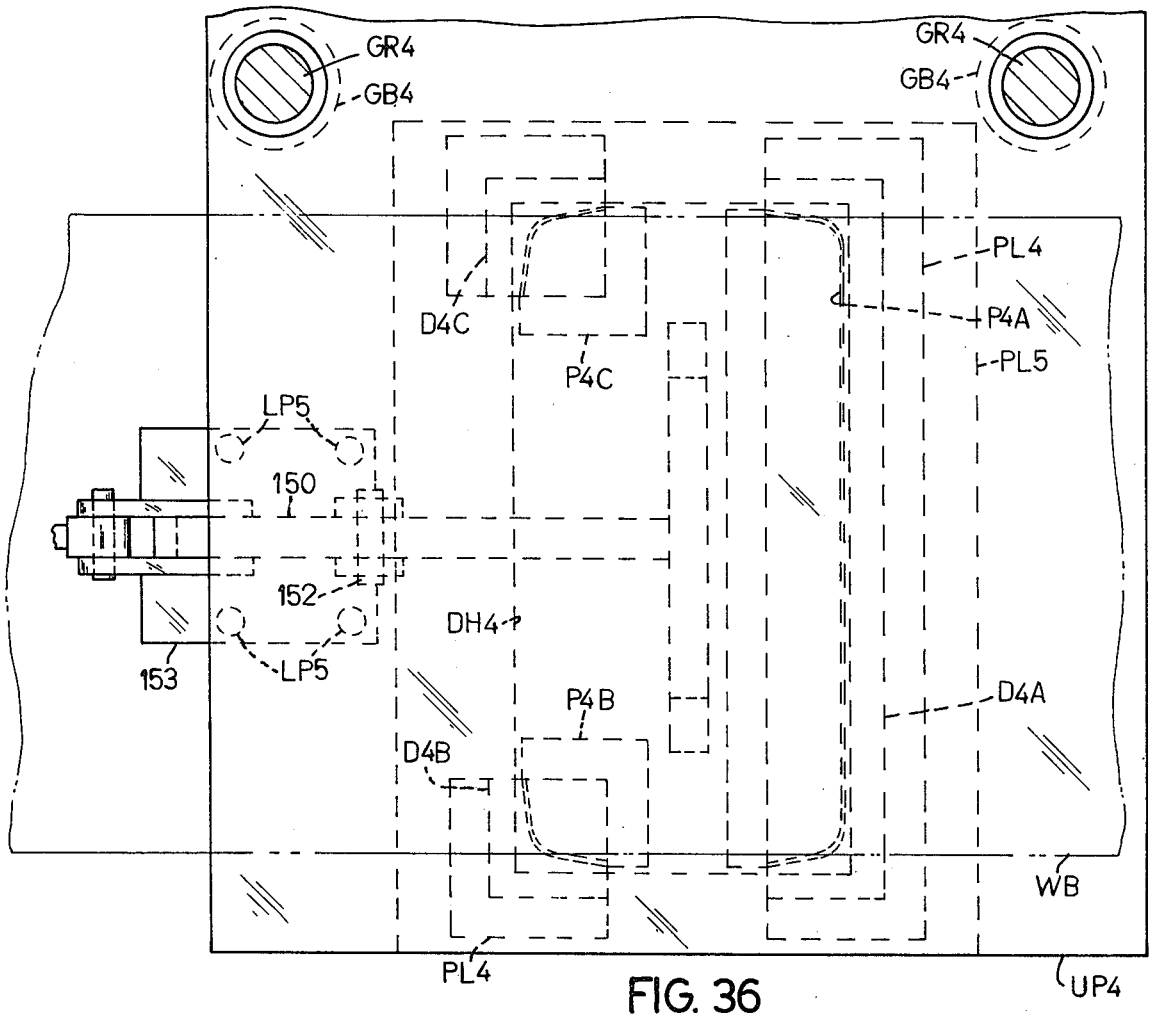
Figure 37:
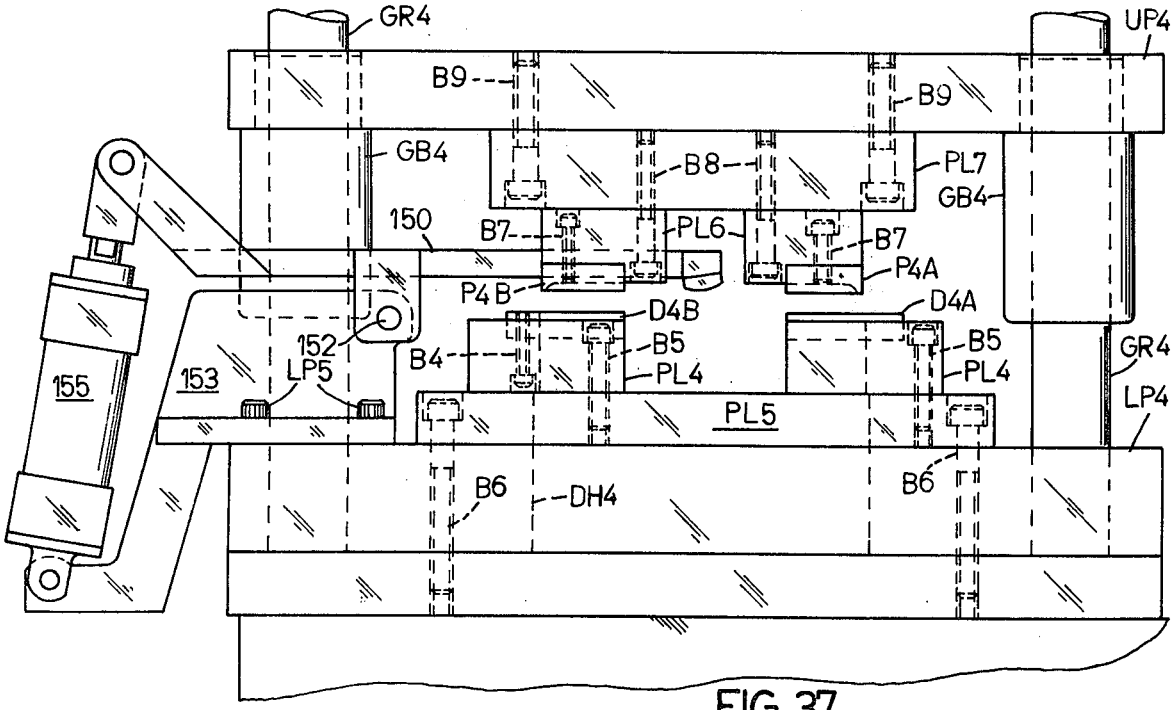
Figure 38:
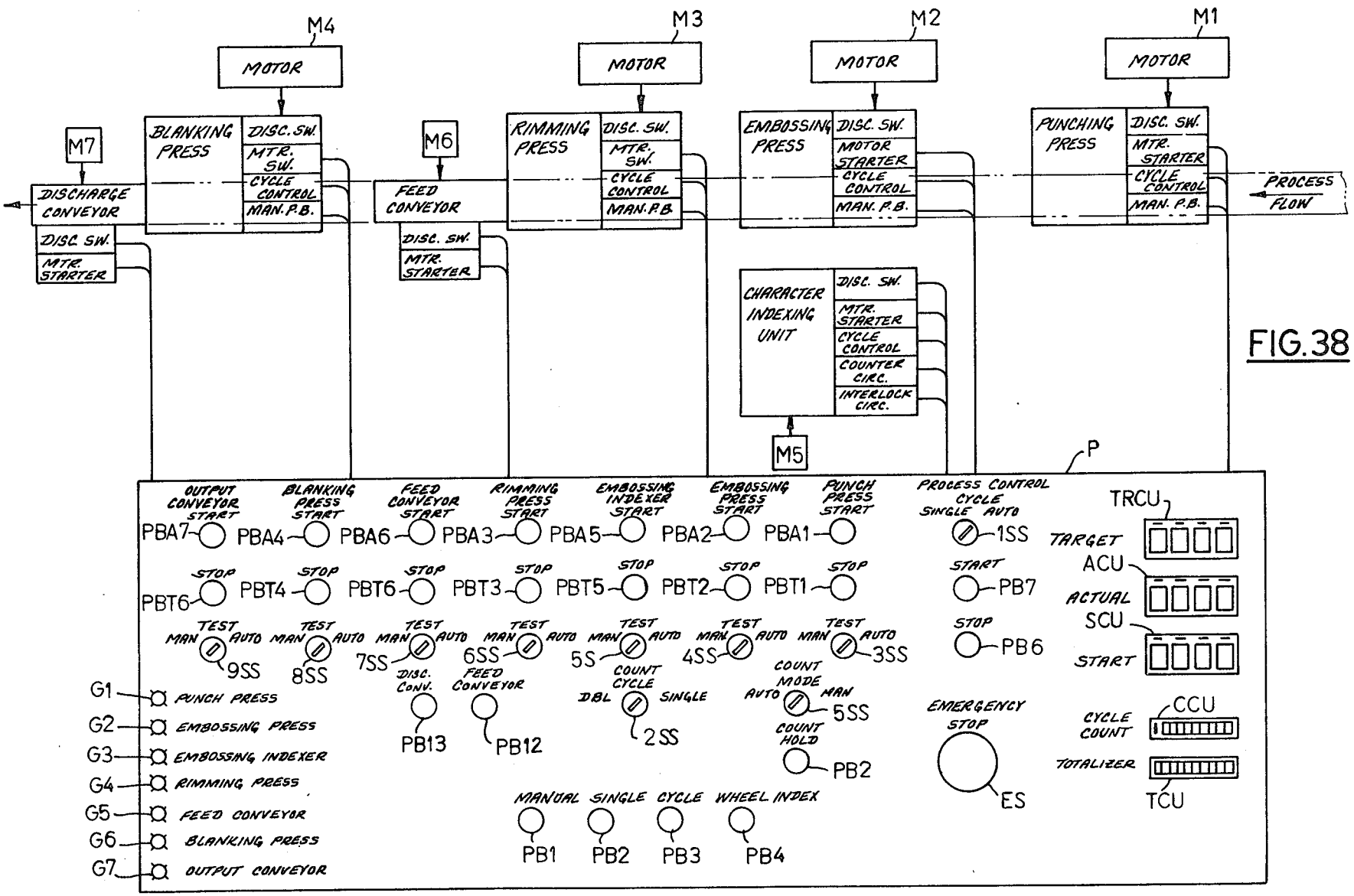
Figure 39:
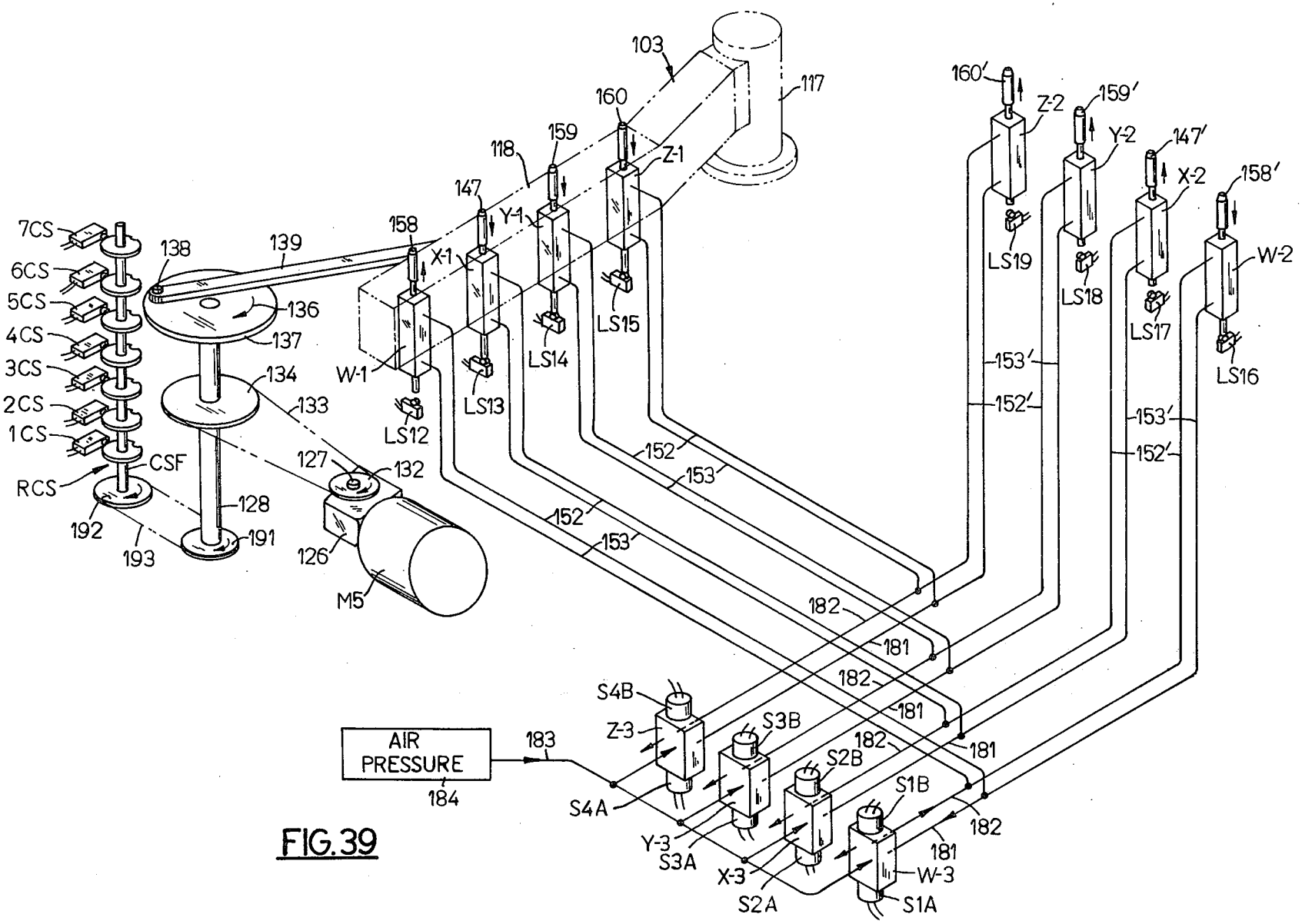
Figure 40:
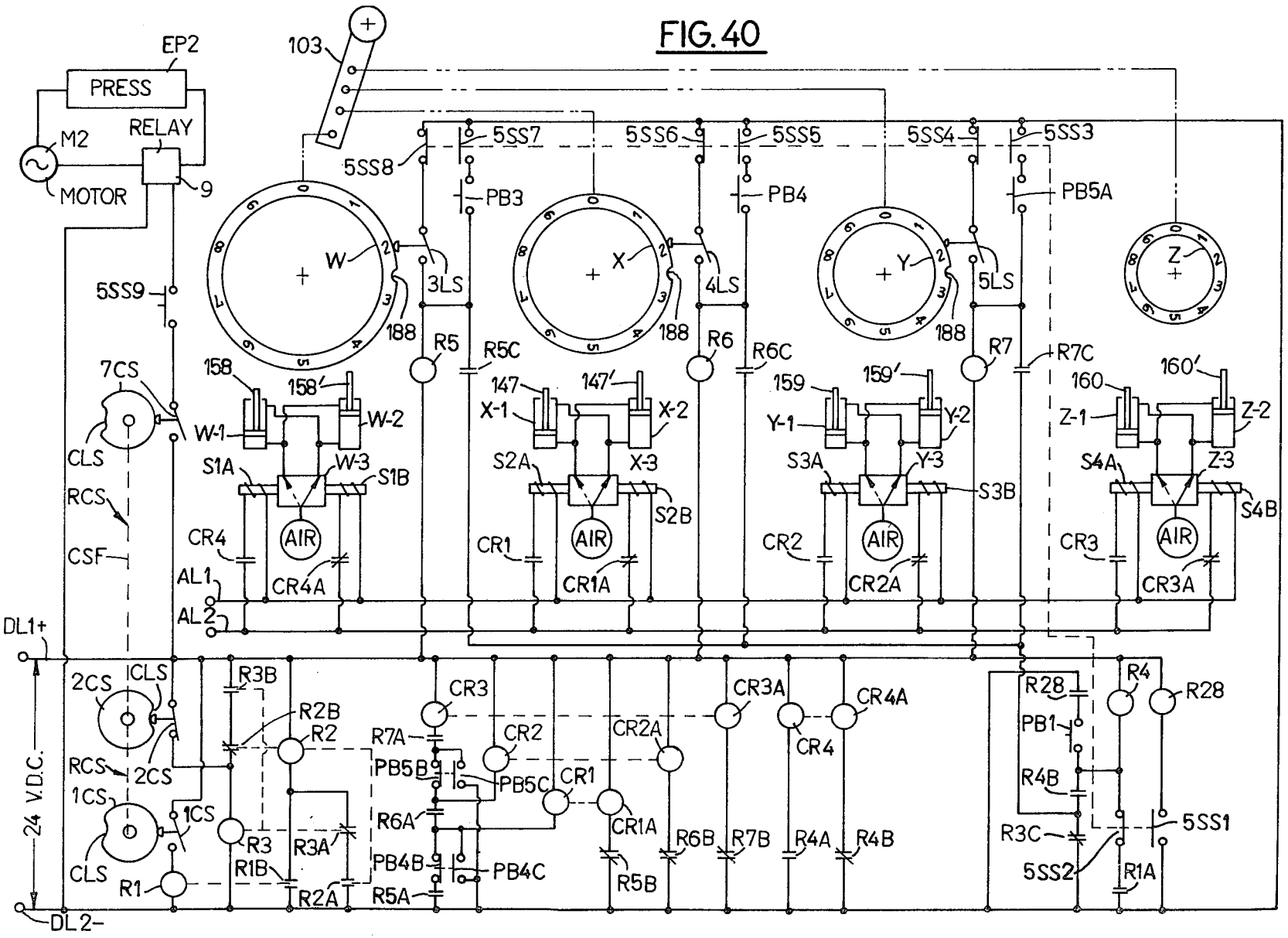

FIGS. 3, 4, 5, and 6 are elevation views of portions of the right sides of the punching, embossing, rimming and blanking presses, respectively, shown in FIG. 1;

FIG. 7 is an enlarged top plan view of the punching press of FIG. 1;

FIG. 8 is a front side view, partly in section, of the press of FIG. 7;

FIG. 9 is an enlarged perspective view of the embossing press and numerical registering device shown in FIG. 1, with the shiftable subframe of the indexing mechanism withdrawn from the embossing press;

FIG. 10 is a view similar to FIG. 9 showing the subframe inserted into the embossing press;

FIG. 11 is a top plan view of the numerical registering device showing its indexing arm at start-of-count stroke position;

FIG. 12 is a view similar to FIG. 11, but showing the indexing arm at end-of-count stroke position;

FIG. 13 is a side elevational view of the numerical registering device as shown in FIG. 10;

FIG. 14 is a top plan view similar to FIG. 11, but with parts omitted to exposure interior structure;

FIG. 15 is a front elevational view of the interior of the numerical registering device taken on line 15—15 of FIG. 11;

FIG. 16 is a view partly in section of the indexing arm and clutch unit taken on line 16—16 of FIG. 12;

FIG. 17 is a view partly in section taken on line 17—17 of FIG. 16;

FIG. 18 is a cross section view of the lock unit shown in FIG. 14 taken on line 18—18 of FIG. 14;

FIG. 19 is an elevation view of the lock unit taken on line 19—19 of FIG. 14;

FIG. 20 is an enlarged top plan view of a portion of the ring support structure shown in FIG. 14;

FIG. 21 is a cross section view taken on line 21—21 of FIG. 20;

FIGS. 22 and 23 are schematic diagrams showing the numerical registering device and certain cams and cam switches in various operating positions;

FIG. 24 is a top plan view of the count switch assembly shown in FIG. 14;

FIG. 25 is a view taken on line 25—25 of FIG. 24;

FIG. 26 is a view partly in section taken on line 26—26 of FIG. 25;

FIG. 27 is an enlarged perspective view showing the interior of the cam switch assembly shown in FIGS. 9, 10, 11, 12 and 15;

FIG. 28 is an enlarged perspective view showing the assocation of a typical cam and cam switch in the assembly of FIG. 27;

FIG. 29 is a top plan view of a portion of the cam shown in FIG. 28;

FIG. 30 is an enlarged top plan view of the rimming press of FIG. 1 and showing a lower die for a license plate to be formed on the web passing therethrough;

FIG. 31 is a front view, partly in section, of the press of FIG. 30;

FIG. 32 is an enlarged elevational view of the feed conveyor shown in FIG. 1;

FIG. 33 is a top plan view of the conveyor of FIG. 32;

FIG. 34 is a view, partly in section, taken on line 34—34 of FIG. 32;

FIG. 35 is an enlarged view of a portion of the conveyor shown in FIG. 34;

FIG. 36 is an enlarged top plan view of the blanking press of FIG. 1;

FIG. 37 is a front view of the press of FIG. 36;

FIG. 38 is a schematic diagram of an electrical control panel for the apparatus of FIG. 1;

FIG. 39 is a perspective diagram of a pneumatic circuit and associated components for the numerical registering device shown in FIG. 9;

FIG. 40 is a diagram of a portion of the pneumatic and electrical control system for the numerical registering device; and FIGS. 41 through 47, taken together, show a schematic diagram of the complete electrical control means or system for the apparatus shown in FIG. 1.

DESCRIPTION OF A PREFERRED EMBODIMENT

GENERAL ARRANGEMENT

Referring to FIGS. 1 through 6, apparatus in accordance with the invention for manufacturing discrete embossed consecutively numbered elements or segments, such as automobile license plates, from a continuous web or strip WB of sheet material, such as sheet metal, supplied from a roll R comprises the following principal components, namely: a punching press PP1 for punching mounting holes in web W for each license plate; an embossing press EP2 cooperable with an associated numerical registering device or indexing unit IU5 for embossing consecutive serial numbers (and any related letters) in web WB for each license plate; a rimming press RP3 for embossing, for example, a raised rim, an expiration date, state or origin, and a slogan (and indexing holes) in web WB for each license plate; a feed conveyor FC6 for drawing or pulling web WB in stages or steps from Reel R through the presses PP1, EP2 and RP3; a blanking press BP4 for cutting or shearing fully punched and embossed segments or plates (hereinafter called blanks) of predetermined size from web WB; and a discharge conveyor DC7 for collecting and routing the blanks to other stations (not shown) for finishing operations.

The presses are rigidly mounted in predetermined spaced apart relationship on a supporting base SPB which, in turn, is affixed to a floor FL. The four presses, PP1, EP2, RP3 and BP4 are provided with electric motors M1, M2, M3 and M4, respectively, which are supplied with electric power from a suitable source through conductors which are understood to be disposed in a conduit CO to supply motor starters disposed in the motor starter housings MSH1, MSH2, MSH3 and MSH4, respectively, attached to the sides of the presses. Indexing unit IU5 and the conveyor FC6 and DC7 are provided with electric motors M5, M6 and M7, respectively which are also supplied with electric power from the suitable source. During normal automatic operation of the apparatus, the motors M1 thru M7 are always energized and running. The motors M1, M2, M3, M4, M6, and M7 deliver mechanical operating power on demand to the component they drive through suitable clutches CL1, CL2, CL3, CL4, 125 and M7A, respectively, as hereinafter described. The clutches CL1, CL2, CL3 and CL4 for the press motors M1 through M4, respectively, are understood to by hydraulically actuated in response to operation (energization) of electrically operated press actuator valve solenoids R13 through R16, respectively, shown in FIG. 42, for valves V1, V2, V3, V4. Such an arrangement is disclosed in detail in U.S. Pat. No. 2,297,558 issued Mar. 8, 1960 to Smilges for "Hydraulic Press and Control Means". The conveyor motors M6 and M7 operate continuously and drive through electromechanical clutches 125 and M7A which respond to operation (energization) of electrically operated conveyor clutch solenoids CL6 and CL7, respectively. The motor M5 continuously drives its associated components, such as indexing arm 3 without the need for a clutch during system operation.

The presses PP1, EP2, RP3 and BP4 are provided with stationary lower platens generally designated LP1, LP2, LP3 and LP4 and with vertically movable upper platens generally designated UP1, UP2, and UP3 and UP4 in FIGS. 1 through 6. However, the lower platen Lp2 of embossing press EP2 is actually embodied in the indexing unit IU5 in the form of concentric movable rings hereinafter described in detail. The platens LP1 and UP1 from punching press PP1 are shown in detail in FIGS. 7 and 8. The platens LP2 and UP2 for embossing press EP2 are described in detail hereinafter in connection with the FIGS. 9 and 10 depicting registering device IU5. The platens LP3 and UP3 for rimming press RP3 are shown in detail in FIGS. 30 and 31. The platens LP4 and UP4 for blanking press BP4 are shown in detail in FIGS. 36 and 37. The feed conveyor FC6 is shown in detail in FIGS. 32, 33, 34 and 35.

Generally considered the registering device IU5 comprises a concentric assembly of decimal rings W, X, Y, Z which is successively adjusted to progressive serial number configurations by an automatic indexing arm 103, a drive mechanism (driven by electric motor M5) for swinging the indexing arm 103 alternately in one direction through a counting stroke and in the opposite direction through an idling stroke, and an electropneumatically actually coupling system comprising clutch units W-1, X-1, Y-1, Z-1 between the indexing arm 103 and the ring assembly for progressively advancing the decimal rings by successive counting strokes of the indexing arm. An electro-pneumatically actuated locking system comprising lock units W-2, X-2, Y-2, Z-2 for the decimal rings immobilizes all rings during idling strokes of the indexing arm 103 and releases the coupled decimal ring or rings during the counting strokes of the indexing arm.

A control panel P, shown in FIG. 38, contains selector switches, pushbutton control switches, fault indicator lights, and counter units which afford a visual information display and is preferably associated with a control cabinet which contains certain of the control relays and circuitry shown in FIGS. 41 through 47.

As FIG. 38 shows, panel P comprises the following selector switches; two-position mode selector switch 5SS to enable system operation in the automatic mode or the manual mode; a two-position cycle selector switch 1SS to enable (in the automatic mode) a single automatic cycle or a continuous automatic cycle; and a two-position count cycle selector switch 2SS to enable a consecutive serial number change for each blank in a series (a single count) or a consecutive serial number change for each pair of blanks in a series (a double count).

Figure 41:
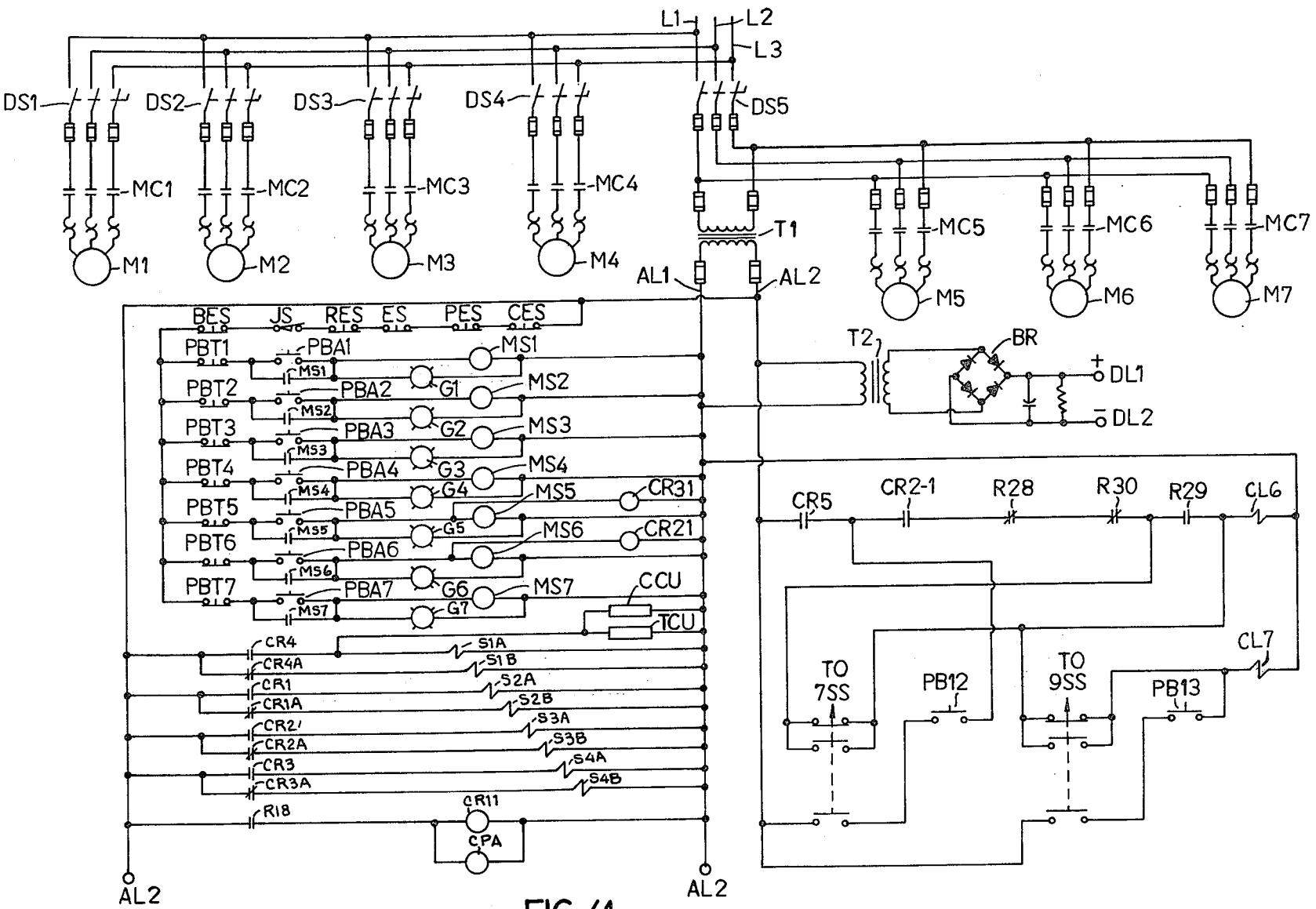

Panel P also comprises seven three-position motor control selector switches 3SS, 4SS, 5S, 6SS, 7SS, 8SS and 9SS to enable operation of the motors M1, M2, M5, M3, M6, M4 and M7, respectively, in test, manual or automatic modes. These switches must all be set at automatic to enable automatic system operation. The motors M1 through M7 are also provided with normally open pushbutton motor start switches PBA1 through PBA7, respectively, and with normally closed pushbutton motor stop swtiches PBT1 through PBT7, respectively. The motors are all started individually for any system mode to reduce the starting load on the power line and can all be stopped individually. However, an emergency stop pushbutton switch ES is provided on panel P to stop all motors simultaneously, and as FIG. 41 shows, this switch is in series with other press-mounted pushbutton switches BES, RES, PES, CES (and a web jam limit switch JS), each of which can stop all motors simultaneously.

Normally open pushbutton switches PB12 and PB13 are provided to manually operate the feed conveyor FC6 and the discharge conveyor DC7, respectively.

Pushbutton switches PB7 and PB6 are provided to start and stop the system during either automatic single cycle or automatic continuous cycle operation.

A count hold pushbutton switch PB2 is provided to prevent advancement of a serial number (and counting thereof) in particular instances and enable a repeat embossment thereof on the web WB.

Normally open pushbutton switches PB1, PB3, PB4 and PB5 are provided to enable the rings W, X, Y and Z, respectively, to be individually advanced to desired positions when system operation is in the manual mode.

The control panel also comprises indicator lights designated G1 through G7 which illuminate to indicate the location of a system fault, such as failure of a motor relay to energize.

The control panel also comprises five counter units which afford a visual information display. The target counter unit TRCU is preset to the final serial number to be embossed on the web. The start counter unit SCU indicates the serial number at which the indexing unit IU5 is set at the start of a production run. The acutal count unit ACU indicates the serial number currently being embossed on web WB at any point in a production run. The cycle count unit CCU is manually resettable and indicates the number of units (i.e., operations) produced during a particular short term production run, as for example, during one shift. The totalizer counter unit TCU, which is non-resettable manually, indicates the total number of units (i.e., operations)

produced since the apparatus was set up for a particular production run, as for example, a run of plates of one series or for one state.

Generally considered, the control system enables operation of the apparatus in two basic modes through use of switch 1SS; namely, an automatic continuous cycle mode and an automatic single cycle mode. However, switch 5SS makes available a manual mode wherein certain components can be operated individually. In the automatic continuous cycle mode, one complete cycle of operation involves the steps of: operation of the feed conveyor FC6 to advance the web W one stage through all the presses while the presses are open; operation of the numerical registering device IU5 simultaneously with web advance to rotate the appropriate ring or rings one step so that the appropriate license plate serial number appears; and, after the steps of web advance and ring advance, simultaneous closure of all four presses to punch mounting holes in the web segment in the punching press PP1, to emboss the license plate numerals in the web segment in the embossing press EP2, to emboss the rim (and legends) and punch the web advance holes in the web segment in the rimming press RP3, and to cut or shear off a blank at the end of the web in the blanking press BP4. After this last step, the described cycle is automatically repeated. In an automatic single cycle mode, only one cycle of operation as above described is carried out. In the latter mode, each conveyor may be selectively operated individually by means of the switches PB12 and PB13 and each ring may be individually advanced any number of steps to provide a desired combination of numbers by means of the switches PB1, PB3, PB4, and PB5, as hereinafter explained.

Generally considered, the control system also comprises limit switches on the presses, conveyors and registering device to insure proper system sequencing and operation of other components as hereinafter described in detail.

DETAILED DESCRIPTION OF THE PRESSES

As FIG. 22 shows, each of the four presses comprise a main frame MF of the open gap or C type; a reciprocating ram RR, and a hydraulic power unit HP within a hollow upper part of the frame. Also enclosed within the hollow upper part of the C frame are the respective electric motor for the press, a hydraulic pump HHP, and a belt drive BL connecting the motor with the pump. The hydraulic power unit includes an internal hydraulic circuit which is supplied with pressure fluid by the pump and which is controlled by the solenoid valve for the press. When the coil of the solenoid valve is energized, hydraulic pressure builds up within the power unit and forces the ram down on working stroke, and when the solenoid coil is subsequently de-energized, the ram moves automatically from its lowered position to a raised position. The pressure PP1, EP2, RP3, BP4 (FIG. 1) are provided with top of stroke limit switches 21LS, 22LS, 23LS, 24LS, respectively, and with bottom of stroke limit switches 8LS, 10LS, 11LS, 9LS, respectively.

Figure 2:
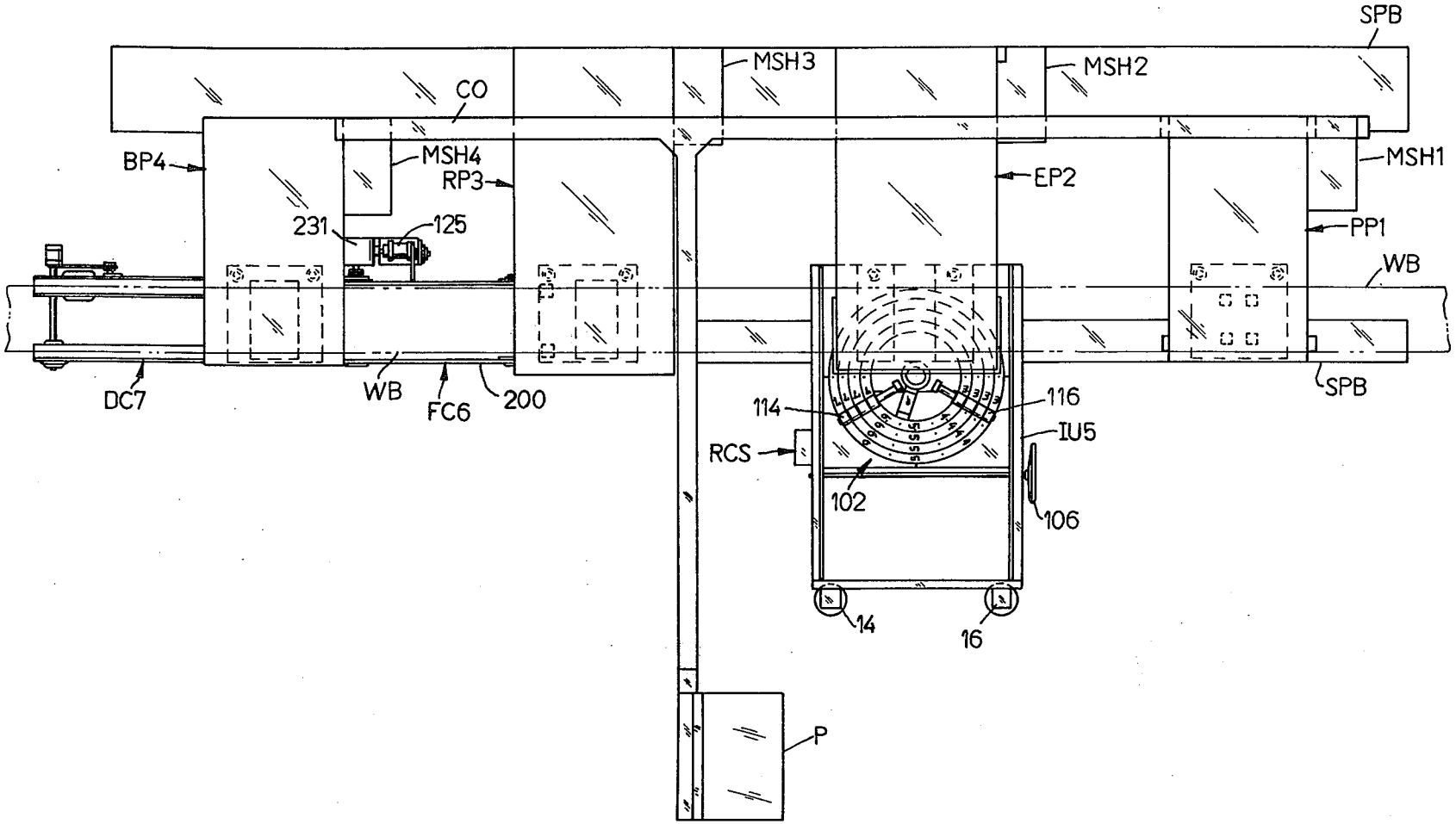
FIG. 2 is a top plan view of the apparatus of FIG. 1.

As FIGS. 1, 2 and 3 show, the principal structural components of the punching press PP1 which is adapted to punch four mounting holes in the web WB for each license plate blank are a stationary main frame MF1 on which are mounted the motor M1, a solenoid operated actuator valve V1 for clutch CL1 and its solenoid R15, the lower platen LP1 and the upper platen UP1. As FIGS. 7 and 8 show, the lower platen LP1 comprises a pair of spaced apart guide rods GR1 which extend through guide sleeves or bushings GB1 on the upper platen UP1 to insure proper registering of those platens during press operation. Lower platen LP1 is provided with four dies D1 affixed in appropriately spaced apart relationship, each having a die hole DH1 therein, the upper platen UP1 is provided with four punches P1 for cooperation with the four dies D1. The punches P1 extend through holes HL in a movable plate PL1 which is secured to the upper platen UP1 by bolts B which are secured in threaded engagement to bolt holes BH in the plate PL1 but are slideable in holes SL1 in upper platen UP1. Biasing springs BA1 are provided around each bolt B between the upper platen UP1 and the plate PL1. During a closing operation of press PP1, the plate PL1 presses web WB against the dies D1 and holes it firmly in place as the punches P1 continue downward and pierce the holes 114 in web WB. The holes 114 formed in the web WB serve as mounting holes on a finished license plate.

As FIGS. 1, 2 and 4 show, the principal structural components of the embossing press EP2 which is adapted to cooperate with the numerical registering device IU5 to punch license plate serial numbers in the web WB for each license plate blank are a stationary main frame MF2 on which are mounted the motor M2, a solenoid operated actuator valve V2 for clutch CL2 and its solenoid R13, the lower platen LP2 and the upper platen UP2. As FIGS. 9 and 10 show, the lower platen LP2 of embossing press EP2 takes the form of the radial assembly of the decimal rings W, X, Y, Z, hereinafter described in detail in connection with the numerical registering device IU5. Upper platen UP2 is provided with a block D2 of yieldable material, such as polyethylene plastic, which forces web W against and in conformity with the appropriate decimal ring numerals and other indicia of device IU5 during press closure to form the numerals and other indicia in the web. A block such as D2 is described in more detail in U.S. patent application Ser. No. 296,602, hereinbefore referred to.

As FIGS. 1, 2, and 5 show, the principal structural components of the rimming press RP3 which is adapted to punch an annular rim, an appropriate legend and indexing holes 120 in the web WB for each license plate blank are a stationary main frame MF3 on which are mounted the motor M3, a solenoid operated actuator valve V3 for clutch CL3 and its solenoid R14, the lower platen LP3 and the upper platen UP3. As FIGS. 30 and 31 show, the lower platen LP3 comprises a pair of spaced apart guide rods GR3 which extend through guide sleeves or bushings GB3 on the upper platen UP3 to insure proper registering of those platens during press operation. Lower platen LP3 is provided with a male die D3 and a pair of hole punching dies D3A and D3B affixed in appropriately spaced apart relationship, each die D3A and D3B having a die hole DH3 therein. Upper platen UP3 is provided with a female die D3C for cooperation with male die D3 and two punches P3 for cooperation with the two dies D3A and D3B. The punches P3 extend through holes HL3 in a movable plate PL3 which is secured to the upper platen UP3 by bolts B3 which are secured in threaded engagement to bolt holes BH3 in the plate PL3 but are slideable in holes SL3 in upper platen UP3. Biasing springs BA3 are provided around each bolt B3 between the upper platen UP3 and the plate PL3. During a closing operation of press RP3, the plate PL3 presses web W against the dies D3A and D3B and holds it firmly in place as the punches P3 continue downward and pierce holes 120 in the web WB. The holes 120 formed in the web WB serve as a means by which feed conveyor FC6 draws or advances the web WB in steps or stages through the presses. Die D3 is rigidly secured to lower platen LP3 by bolts BL3.

As FIGS. 1, 2 and 6 show, the principal structural components of the blanking press BP4 which is adapted to cut off finished blanks from the end of the web WB are a stationary main frame MF4 on which are mounted the motor M4, a solenoid operated actuator valve V4 for clutch CL4 and its solenoid R16, the lower platen LP4 and the upper platen UP4. As FIGS. 36 and 37 show, the lower platen LP4 comprises a pair of spaced apart guide rods GR4 which extend through guide sleeves or bushings GB4 on the upper platen UP4 to insure proper registering of those platens during press operation. Lower platen LP4 is provided with three cutting dies D4A, D4B and D4C affixed in appropriately spaced apart relationship about or around a central opening or hole DH4 through which a cut-off blank falls into the discharge conveyor DC7. Upper platen UP4 is provided with three corresponding cutting dies P4A, P4B, and P4C for cooperation with the three dies D4A, D4B and D4C, respectively. The dies D4A, D4B, and D4C are secured by bolts B4 to blocks PL4 which, in turn, are secured to a plate PL5 by bolts B5. Plate PL5 is secured to the lower platen LP4 by bolts B6. The dies P4A, P4B and P4C are secured by bolts B7 to blocks PL6 which, in turn, are secured to a plate PL7 by bolts B8. Plate PL7 is secured to upper platen UP4 by bolts B9. During a closing operation of press BP4, the upper and lower dies cooperate to cut a blank from web WB. A lever 150 pivotable about a pin 152 on a bracket 153 affixed to lower platen LP4 by bolts PL5 is operated by a pneumatic cylinder 155 to strike a blank after it has been cut from web WB and propel it downwardly through hole DH4 onto discharge conveyor DC7. Cylinder 155 is connected by known means (not shown) to a supply of compressed air in press BP4 and effects one approximately timed stroke of operation for each press operation.

DETAILED DESCRIPTION OF THE FEED CONVEYOR

Referring to FIGS. 1, 2, 32, 33, 34 and 35, the principal structural components of the feed conveyor FC6 are a stationary main frame 200, an idler shaft 202 supported on bearings 204 mounted on main frame 200 and having a pair of spaced apart idler sprockets 205A and 205B keyed thereto for rotation therewith, and a drivable shaft 206 supported on bearings 203 mounted on main frame 200 and having a pair of spaced apart chain drive sprockets 206A and 206B keyed thereto for rotation therewith.

A flexible endless chain 210A is disposed around the idler sprocket 205A and the driven sprocket 206A and a flexible endless chain 210B is disposed around the idler sprocket 205B and the driven sprocket 206B. Means are provided to maintain proper tension on the chains 210A and 210B and comprise a shaft 207 supported for rotation on bearings 208 which are mounted on adjustable support brackets 209 which, in turn, are secured to main frame 200 by bolts 209A. Shaft 207 has a pair of spaced apart chain tensioning sprockets 211A and 211B secured thereto for rotation therewith which engage the lower side of the chains 210A and 210B, respectively. A series of bars 212 are connected at spaced apart intervals to the chain 210A and 210B, as by means of links or brackets 215 which are connected to the chain by pins 216 and riveted to the undersurface of the bars, and each bar is provided with two spaced apart lugs or projections 213 which are adapted to engage holes 120 in web WB which were previously punched therein by rimming press RP3. Thus, a means is provided to draw web WB in the direction of the arrow 218 as the driven sprockets 206A and 206B are rotated in the direction of the arrow 219 by rotation of shaft 206.

Each link 215 which supports a bar 212 comprises two spaced apart side portions 215A and 215B between which two chain rollers 217 are connected, as by the pins 216. The rollers 217 in each chain 210A and 210B ride along the upper surface of a horizontally disposed guide rail or member 226 which is rigidly but adjustably secured to the sides of main frame 200. The member 226 prevents the upper sides of the chains 210A and 210B from sagging and thus insure proper engagement of the lugs 213 with the holes 120 in web WB. Member 226 can be vertically adjusted by screws 226A.

To further insure that the lugs 213 engage the holes 120 in web WB, means such as web hold-down assemblies 240 and 241 are provided on main frame 200 on opposite sides of the web. Each web hold-down assembly 240 and 241 comprises a support plate 243 which is rigidly secured to a side of main frame 200 by bolts 244. An arm 245 is pivotally connected to plate 243 by a pin 246. A top plate 247 is rigidly secured to the free end of arm 245 by bolts 248 and a nylon block 250 is rigidly secured to the free end of plate 247 by bolts 251. Each assembly 240 and 241 is swingable 90 degrees between one position wherein it is clear of web WB, as FIG. 35 shows, and another position, shown in FIG. 34, wherein the nylon block 250 bears against the upper surface of web WB in sliding engagement and presses the web against the bars 212 on the upper side of the conveyor chains 210A and 210B.

Means are provided to rotate shaft 206 so that the chains 210A and 210B advance together one step of predetermined length (i.e., about six inches, for example) at predetermined interals of time and thus advance the web WBa corresponding distance. Thus, the output shaft 220 of feed conveyor motor M6 has a drive sprocket 221 keyed thereto and the latter is connected by a drive chain 222 to a driven sprocket 223 on the input shaft 224 of a known type of single revolution clutch 125. The output shaft 227 of clutch 125 is connected to an input shaft 230 of a conventional speed reduction gear box or power transmission unit 231 and the output shaft 232 of unit 231 is coupled to drive the drivable shaft 206 of the feed conveyor FC6. Feed conveyor motor M6 is in constant rotation when the system is in operation but delivers power to shaft 206 to move the chains 210A and 210B only in response to energization of a feed conveyor clutch solenoid CL6 (also shown in FIG. 41) which is part of the clutch 125 and is described hereinafter in connection with the detailed description of the control system. More specifically, each time solenoid CL6 is energized, the output shaft 227 of clutch 125 exhibits one revolution. Power transmission unit 231 is adapted so that one revolution of its input shaft 230 results, for example, in one-third of one revolution of its output shaft 232 and this, in turn, effects one-third of one revolution of the drivable conveyor shaft 206 an the sprockets 206A and 206B driven thereby. This movement, in turn, results in the aforementioned predetermined advance of chains 210A and 210B and lugs 213 carried thereby and effects corresponding movement of web WB. Of course, other ratios and lengths of web advance are possible and would be dictated by the extent of web advance required in a particular system to provide blanks of required size. Web WB is advanced when the four presses are open and the numerical registering device IU5 is effecting a serial number change by appropriate ring advance.

The single revolution clutch 125 is a commercially available type of clutch and may, for example, take the form of a type single revolution clutch manufactured by the Warner Brake Company.

Conveyor FC6 includes a product motion limit switch 20LS.

THE DISCHARGE CONVEYOR

As FIGS. 1 and 2 show, the principal structural components of the discharge conveyor DC7 which is adapted to receive and transport blanks formed by blanking press BP4 are a stationary main frame MF5 on which are mounted the motor M7, an output or discharge conveyor clutch M7A driven by motor M7 by a drive belt M7B and similar in construction and operation to single revolution clutch 125 hereinbefore described in detail, in connection with the feed conveyor FC6, a shaft M7C intermittently driven by clutch M7A, and a conveyor belt M7D driven by shaft M7C and having its upper surface disposed beneath discharge hole DH4 in the lower platen LP4 of the blanking press BP4. Clutch M7A is operated in response to energization of an output clutch solenoid coil CL7 (also shown in FIG. 41). As each blank is cut from web WB it is deposited on conveyor belt M7D and transported, when the belt is moved, to a discharge chute CHT.

DETAILED DESCRIPTION OF THE NUMERICAL REGISTERING DEVICE

The principal structural components of the registering device IU5 shown in FIG. 9 and elsewhere are a stationary main frame 101, a shiftable subframe 102, a concentric radial assembly of four decimal rings W, X, Y and Z, an indexing arm 103, and a drive mechanism for the indexing arm generally designated by the reference character 104.

The frame of embossing press EP2 is secured to the frame generally designated by the reference character 101. The extension frame 101 comprises a pair of side beams 11 and 12, a front cross beam 13, and a pair of front supporting legs 14 and 16. The rear ends of the side beams 11 and 12 are rigidly secured to opposite side portions of the press frame, and the front legs 14 and 16 sustain the beam assembly 11, 12 and 13 in a horizontal position. Slidably mounted on the side beams 11 and 12 of the extension frame 101 for horizontal back and forth movement relative to the press frame is the subframe 102, and operatively mounted on the subframe 102 is a numerical registering device comprising the concentric radial assembly of four decimal rings W, X, Y and Z, an oscillating indexing arm 103, and a drive mechanism for the indexing arm, generally designated by the reference character 104.

A rack and pinion drive 105 is operable by a hand wheel 106 to shift the subframe assembly 102 back and forth within the main frame. Such adjustment of the subframe is provided for purposes of adapting the registering device to environmental structure, such as embossing press EP2, and has no effect upon its operation.

In FIG. 14, the subframe 102, is shown without the decimal rings to expose an anvil 107 having arcute ring support rails 107*a*, 107*b*, 107*c* and 107*d* and two radial support rails 108 and 109 which are secured in fixed positions on the subframe 102 and on which the concentric decimal rings W, X, Y, Z are supported in rotable relation to each other. Each of the decimal rings has a circular groove (FIG. 16) at its under side, and these grooves 99 are engaged by eccentrically mounted guide rollers 111 on the anvil 107 and by corresponding guide rollers 112 and 113 on the support rails 108 and 109, respectively, to keep the rings centered on a common axis. The guide rollers 111, 112 and 113 are all eccentrically mounted on adjustable bushings 111*a*, 112*a* and 113*a* respectively to thereby place outwardly thrust on the rings against their groove wall. Radial holddown rollers 114 and 116 are suitably mounted on the subframe 102 in contact with the upper sides of the decimal rings to prevent upward separation of the rings W, X, Y, Z from the guide rollers 11, 112 and 113.

In addition to the radially concentric assembly of relatively rotatable decimal rings W, X, Y, Z, prefix embossing characters A, A (FIG. 20) are provided at the embossing station adjacent the inner periphery of the decimal ring Z. As shown in FIGS. 20 and 21, a pillow block 296 having rectangular pockets 297 and 295 is secured to the platform 173 of the subframe 102 by four cap screws 298, a spacer block 299 (FIG. 21) being interposed between the platform 173 and the pillow block 296. The embossing characters A are formed in relief on type blocks 301 and 302, which are removably fitted into the pockets 297 and 295, respectively. As shown in FIGS. 20 and 21, another pillow block 303 having rectangular pockets 304, 305, 306 may be provided on the subframe 102 at the embossing station adjacent the outer periphery of the decimal ring W. Type blocks bearing suffix embossing characters (not shown) may be removably fitted into the pockets 304–306, if desired.

The indexing arm 103 (FIG. 16) has a hub sleeve 117 and a bracket end 118 extending radially outward from the sleeve 117 below the decimal rings W, X, Y, Z. Conical roller bearings 119 and 121 mount the arm 103 on the king pin 122 which is flanged to the subframe by cap screws 123 and extends axially of the rings W, X, Y, Z on the common axis of the latter.

The drive mechanism 104 for oscillating the indexing arm 103 about the axis of the king pin 122 is best shown in FIGS. 15 and 39. It comprises the electric motor M5, a speed reduction unit 126 connected to the motor M5 and having a rotary output shaft 127; a counter shaft 128 mounted on the subframe 102 in bearings 129 and 131 (FIG. 15) for rotation on an axis extending parallel to and spaced radially from the axis of the king pin 122. A pulley 132 (FIG. 15) on the output shaft 127 of the speed reduction unit 126 is connected by a belt 133 with a sheave 134 which is keyed to the counter shaft 128. The transmission ratio between the motor M5 and the counter shaft 128 is so proportioned that the counter shaft 128 rotates in the direction of arrow 136 at a speed which is substantially lower than the armature speed of electric motor M5, a suitable speed for the counter shaft 128 being, for instance, 80 RPM. A disc 137 (FIG. 15) is keyed to the shaft 128 for rotation therewith in a plane somewhat below the bracket end 118 of the indexing arm 103. The disc 137 (FIG. 14) mounts an eccentric pin 138, and a connecting rod 139 is pivotally connected at one end of the eccentric pin 138, and at its other end to a wrist pin 141 on the indexing arm 103.

The radial spacing of the eccentric pin 138 from the axis of the counter shaft 128, and the radial spacing of the wrist pin 141 from the axis of the king pin 122 are so proportioned that a 360° turn of the disc 137 swings the indexing arm 103 in forward and rearward directions about its pivot axis on the king pin 122 through angular range of 36 degrees.

FIGS. 11, 14 and 23 show one of the dead center positions of the connecting rod 139 which places the indexing arm 103 at one end of its 36° swinging range, and FIGS. 12 and 22 show the other dead center position of the connecting rod 139 which places the indexing arm 3 at the other end of its 36 degree range.

A forward stroke of the indexing arm 103 from the FIG. 11 position to the FIG. 12 position will take place upon a 180 degree clockwise turn of the disc 137 from its FIG. 23 position to its FIG. 22 position; and a further 180° clockwise turn of the disc will subject the indexing arm 103 to a return stroke from its FIG. 12 position to its FIG. 11 position. The electric motor M5 drives the disc 137 at constant angular velocity, and during the first 180° clockwise turn of the disc 137 the indexing arm will be gradually accelerated from standstill to maximum angular velocity, and it will then be gradually decelerated to momentary standstill at the end of the forward stroke. During the next 180° clockwise turn of the disc 137 the indexing arm will again be gradually accelerated from standstill at the beginning of the return stroke to maximum angular velocity and during the second half of the return stroke it will again be decelerated to standstill at the end of the return stroke.

In FIG. 23, the dash dotted line 142 designates the radial position to which the indexing arm 103 is swung by a 165° degree clockwise turn of the eccentric pin 138, and the dash-dotted line 143 designates the radial position to which the indexing arm is swung by a 180° clockwise turn of the eccentric pin 138. A short time interval is therefore provided during which the indexing arm remains almost at stand still at the end of its return stroke while the counter shaft 128 continues to rotate at constant angular velocity. The same explanations apply to FIG. 22 where the dash-dotted line 144 designates the radial position to which the indexing arm is swung by a 165° clockwise turn of the eccentric pin 138, and the dash dotted line 146 designates the radial position to which the indexing arm is swung by a 180° turn of the eccentric pin 138. Another short time interval is therefore provided during which the indexing arm remains almost at standstill at the end of its forward stroke while the counter shaft 128 continues to rotate at constant angular velocity.

As will presently be explained in detail, driving connections between the indexing arm and the decimal rings, and locking connections between the decimal rings and the subframe are automatically established and interrupted during the short time intervals at which the indexing arm remains almost at standstill while the counter shaft continues to rotate at constant angular velocity. If, as mentioned previously, the counter shaft rotates at 80 RPM, only microseconds will of course be available for the establishment and interruption of the mentioned driving and locking connections.

As shown in FIG. 16, a bank of four clutch units W-1, X-1, Y-1 and Z-1 are mounted on the bracket end 118 of the indexing arm below the decimal rings W, X, Y, Z, respectively. The clutch unit X-1 provides an engagable and disengagable driving connection between the indexing arm 103 and the decimal ring X by means of a reciprocable clutch pin 147 (FIG. 17) which is connected to the piston rod 148 of a pneumatic cylinder 149. Cap screws 151 secure the cylinder 149 to the under side of the end bracket 118, and hose lines 152 and 153 lead into the cylinder above and below the piston 154 therein. A guide bushing 156 (FIG. 17) for the clutch pin 147 is secured axially within the end bracket 118, and the upper end of the clutch pin 147 is tapered for axial entry into anyone of a circular series of ten equally spaced holes 157 in the decimal ring X.

The foregoing explanations of the clutch unit X-1 analogously apply to the clutch units W-1, Y-1 and Z-1, which comprise clutch pins 158, 159, 160, respectively (FIG. 14) and are operable by associated pneumatic cylinders each having a pair of hose lines 152 and 153. The decimal ring W has a circular series of ten equally spaced clutch pin receiving holes 161; the decimal ring Y has a circular series of ten equally spaced clutch pin receiving holes 162; and the decimal ring Z has a circular series of ten equally spaced clutch pin receiving holes 163, all of these clutch pin receiving holes being each lined with a bushing 164 as shown in FIG. 16.

During each return stroke of the indexing arm from its FIG. 22 position to the position which is indicated in FIG. 23 by the dash-dotted line 142, all of the clutch units W-1, Y-1 and Z-1 are kept in disengaged condition by air pressure admitted to their respective pneumatic cylinders through the upper hose lines 152 (FIG. 17), as will be explained more fully hereinbelow. At the same time all the decimal rings are secured against rotation from their indexed positions by means of four lock units W-2, X-2, Y-2, and Z-2 (FIG. 19) which are mounted on the subframe 102 in the space between the anvil block 107 (FIG. 14) and the ring support rail 109.

The lock units W-2, X-2, Y-2 and Z-2 are substantially duplicates of the clutch units W-1, X-1, Y-1 and Z-1. The lock unit W-2 provides an engageable and disengagable locking connection between the subframe 102 and the decimal ring W, and the lock units X-2, Y-2 and Z-2 similarly provide engagable and disengagable locking connections between the subframe 102 and the decimal rings X, Y and Z, respectively. The lock unit W-2 comprises a reciprocable locking bolt 58' (FIG. 18) which is connected to the piston rod 167 of a pneumatic cylinder 168. Cap screws 169 secure the cylinder 168 to a mounting block 171, which in turn is secured by cap screws 172 to a platform 173 of the subframe 102. Hose lines 152' and 153' lead into the cylinder 168 above and below a piston 176 therein. A guide bushing 177 (FIG. 18) for the lock bolt 158' is secured in the mounting block 171 and the upper end of the lock bolt 158' is tapered for axial entry into any one of the holes 161 of the decimal ring W.

The foregoing explanations of the lock unit W-2 similarly apply to each of the lock units X-2, Y-2 and Z-2. A lock bolt 147' (FIG. 19) of the lock unit X-2 is shiftable axially into and out of any of the clutch pin receiving holes 157 of the decimal ring X; a lock bolt 159' is shiftable axially into and out of any of the clutch pin receiving holes 162 of the decimal ring Y; and a lock bolt 160° is shiftable axially into and out of any of the clutch pin receiving holes 163 of the decimal ring Z.

The mounting block 171 (FIG. 14) for the lock units W-2, X-2, Y-2 and Z-2 is secured on the subframe in such a position that the lock bolts 158 , 147 , 159 and 160 will register with overlying clutch pin receiving holes of the decimal rings W, X, Y, Z, respectively, whenever the indexing arm is in position at the end of a forward stroke (FIGS. 12 and 22).

FIG. 39 is a simplified diagrammatic showing of a pneumatic control system for the clutch units W-1, X-1, Y-1, Z-1 and for the lock units W-2, X-2, Y-2 and Z-2. The indexing arm 103 is shown in FIG. 39, as in FIG. 23, in the starting position for a forward stroke; the clutch pins on the indexing arm are in retracted positions except the clutch pin 158 of the W-1 unit which is in its projected ring W engaging position; and the lock bolts on the subframe are in their projected ring locking positions except the lock bolt 158 which is in its retracted ring W unlocking position. A bank of four solenoid valves W-3, X-3, Y-3 and Z-3 are mounted in fixed positions on the subframe, each valve having two solenoid coils which may be alternately energized by an electrical control circuit as shown in FIG. 41 and which will be discussed more fully hereinbelow.

The solenoid valve W-3 has an air inlet port, an air outlet, and a shiftable valve body, not shown, which in one position, when the solenoid coil S1A is energized, connects the inlet and outlet ports with conduit lines 181 and 182, respectively; and which in another position, when the solenoid coil S1B is energized, connects the inlet and outlet ports with the conduit lines 182 and 181 respectively. The same explanations apply to the solenoid valves X-3, Y-3 and Z-3. The inlet ports of the valves W-3, X-3, Y-3 and Z-3 are connected by a manifold 183 with a source of air pressure 184.

The conduit line 181 of the valve W-3 branches into the hose lines 152 and 153 of the clutch and lock units W-1 and W-2, respectively, and the conduit line 182 of the valve W-3 branches into the hose lines 153 and 152 of the clutch and lock units W-1 and W-2, respectively. Accordingly, admission of air pressure to the conduit line 182 as shown in FIG. 39, projects the clutch pin 158 and simultaneously retracts the lock bolt 158 ; and admission of air pressure to the conduit line 181 would retract the clutch pin 158 and simultaneously project the lock bolt 158 . In other words, the clutch and lock units W-1 and W-2 are interconnected for seesaw operation, that is, when the clutch pin is up the lock bolt is down, and vice versa.

The foregoing explanations of the clutch unit W-1, the lock unit W-2 and valve unit W-3 are equally applicable to the X-1, X-2, X-3 units, and also to the Y-1, Y-2, Y-3 units, and to the Z-1, Z-2 and Z-3 units. The clutch unit X-1 and its associated lock unit X-2, as well as the clutch unit Y-1 and its associated lock unit Y-2, and the clutch unit Z-1 and its associated lock unit Z-2 are operable seesaw fashion the same as the clutch unit W-1 and its associated lock unit W-2.

As shown in FIGS. 11 and 12, each of the decimal rings W, X, Y, Z is provided at its obverse side with a circular series of digits 0 to 9 at 36 circular spacings from each other. The read-out station of the registering device is designated by the radial line R, and in the condition of the device as shown in FIG. 11, the ciphers of all rings are radially aligned so that the readout will be 0-000.

A change from the 0-000 readout of FIG. 11 to the 0-001 readout of FIG. 12 is effected as follows. In the FIG. 11 condition of the device the W ring is coupled to the indexing arm by the projected clutch pin 158 (FIG. 39). The remaining clutch pins are retracted and all rings are locked by the projected lock bolts except the ring W which is unlocked due to the retraction of lock bolt 158 . A forward stroke of the indexing arm 103 from the FIG. 11 position to the FIG. 12 position will therefore turn the ring W one step and thereby bring its number 1 digit into the readout station.

During the last phase of the first forward stroke of the indexing arm, that is, while the arm moves from the line 144 position of FIG. 23 to the line 146 position, the solenoid coil S1A of the valve W-3 is deenergized and at the same time, the coil S1B of the valve W-3 is energized with the result that the driving connection between the indexing arm and the ring W will be interrupted and the locking connection between the subframe and the ring W will be established.

The indexing arm will then start its return stroke from the FIG. 22 position and while it moves from the line 142 position of FIG. 22 to the line 143 position, the solenoid coil S1B of the valve W-3 will be deenergized and at the same time the coil S1A of the W-3 valve will be rere-energized. As a result, the driving connection between the indexing arm and the W ring will be re-established and the locking connection between the W ring and the subframe will be interrupted so that the indexing arm may move through another forward stroke and thereby bring the number 2 digit of the W ring into the readout station.

The described step by step advancement of the W ring will automatically repeat itself in endless succession as long as the driving motor M5 is kept running. However, when the indexing arm 3 moves through the last phase of its ninth return stroke and its driving connection with the W ring will be re-established, the indexing arm will at the same time be coupled to the X ring so that the subsequent forward stroke will advance not only the W ring, but also the X ring one step, and the readout will then be 0.010. Such simultaneously advance of the rings W and X by the tenth advance stroke of the indexing arm is obtained by the transmission of an energizing signal simultaneously to the solenoid coil S1A of the valve W-3 and to the solenoid coil S2A of the valve X-3.

The energizing signal which causes the valve X-3 to couple the indexing arm 103 to the ring X at the end of the ninth return stroke of the indexing arm is produced by a counting switch 3LS (FIG. 25) adjustably mounted by brocket 102B on the subframe 102 below the decimal ring W. The counting switch 3LS has an actuating arm 186 (FIG. 26) which is spring-biased to urge a roller 187 on the arm 186 against the underside of the ring W. A notch 188 at the underside of the ring W permits the switch 3LS to close when the number 9 digit of the W ring moves into the readout station. The switch 3LS opens when the cipher digit of the W ring moves into the readout station and remains open during each successive step of the ring W until the number 9 digit of the ring W again moves into the readout station. The second closure of the 3LS switch causes the ring X to advance one step bringing the number 2 digit of the ring X into the readout station. Continuous step by step advancement of the ring W thus causes the ring X to advance one step after each full revolution of the ring W.

Additional counting switches 4LS and 5LS (FIG. 25) corresponding to the counting switch 3LS are mounted on the subframe 102 below the rings X and Y, respectively. The ring X has a notch like the notch 188 of the ring W, which causes the switch 4LS to close after each full revolution of the ring X; and the ring Y has a similar notch which causes the switch 5LS to close after each full revolution of the ring Y. The switches 3LS, 4LS and 5LS are wired into the control circuit (FIG. 47) for the solenoid valves W-3, X-3, Y-3 and Z-3 in such a manner that continuous rotation of the countershaft 28 will automatically advance the readout of the device step by step from 0-000 to 9-999. The electric control circuit for the solenoid valves W-3, X-3, Y-3 and Z-3 also includes provisions for selectively establishing any desired readout by operation of the indexing arm, as will be explained more fully hereinbelow.

The clutch units W-1, X-1, Y-1 and Z-1 provide selectively engageable and disengageable motion transmitting means which are operatively interposed between the indexing arm 3 and the decimal rings W, X, Y and Z, respectively. A control system for engaging and disengaging the motion transmitting means W-1, X-1, Y-l and Z-1 includes the solenoid valves W-3, X-3, Y-3 and Z-3 whereby the rings may be rotated step by step upon successive forward strokes of the indexing arm and are left in indexed positions during the return strokes of the indexing arm. The motion transmitting means W-1, X-1, Y-1, Z-1 are selectively operable so as to either rotate the decimal rings automatically step by step in predetermined order, as has been explained hereinbefore, or so as to rotate any selected decimal ring step by step independently of the others.

Independent step by step rotation of the W ring is obtained by back and forth oscillation of the indexing arm and coordinated seesaw operation of the clutch and lock units W-1 and W-2 and by maintaining the coil S2A of the solenoid valve X-3 de-energized regardless of closure of the counting switch 3LS.

Independent step by step rotation of the X ring is obtained by back and forth oscillation of the indexing arm and coordinated seesaw operation of the clutch and lock units X-1 and X-2, by maintaining the coils S1B, S3B and S4B of the valves W-3, Y-3 and Z-3, respectively, energized and by maintaining the coil S3A of the valve Y-3 de-energized regardless of closure of the counting switch 4LS.

Independent step by step rotation of the Y ring is obtained by back and forth oscillation of the indexing arm and coordinated seewaw operation of the clutch and lock units Y-1 and Y-2; by maintaining the coils S1B, S2B and S4B of the solenoid valves W-3, X-3 and Z-3, respectively, energized and by maintaining the coil S3A of the solenoid valve Y-3 de-energized regardless of closure of the counting switch 5LS.

Independent step by step rotation of the Z ring is obtained by back and forth oscillation of the indexing arm and coordinated seesaw operation of the clutch and lock units Z-1 and Z-2, and by maintaining the coils S1B, S2B and S3b of the solenoid valves W-3 and Y-3 energized.

As FIGS. 38 and 47 make clear, normally closed limit switches LS12 through LS15, connected in parallel, are disposed below the clutch pins on the indexing arm 3 and, if all of these switches are open simultaneously (indicating that all clutch pins are withdrawn) an appropriate indicator light goes on. Normally open limit switches LS16 through LS19, connected in parallel, are disposed below the lock pins and, if any one of these switches closes (indicating that any lock pin is withdrawn from a ring), an appropriate indicator light goes on.

If preferred, the limit switches LS12 through LS19 and associated circuitry for operation thereof could be eliminated and a plugging switch (not shown) could be mounted on or associated with rotating cam shaft CSF to indicate that the cam switches and indexing arm 3 are in motion when the motor 5 is on. Then, if one of the clutch or lock pins were to jam the movement of arm 3, the plugging switch opens to stop indexing motor 5.

DETAILED DESCRIPTION OF THE CONTROL SYSTEM

FIG. 41 shows a 230 volt alternating current electric power source comprising supply lines L1, L2, L3 for supplying the electric motors M1 through M7 through disconnect switches DS1 through DS5, respectively, and through motor contactors MC1 through MC7, respectively. The lines L1 and L3 also energize the primary winding of a 230/110 volt 60 cycle stepdown transformer T1. The supply lines AL1 and AL2 from the secondary winding of transformer T1 furnish operating power for the motor starter relay coils MS1 through MS7 of the motor contactors MC1 through MC7, respectively, through the series-connected normally closed emergency motor stop pushbutton switches BES, RES, ES, PES, CES and cam switch JS. The motor starter coils MS1 through MS7 are connected in series with the normally closed pushbutton type motor stop switches PBT1 through PBT7, respectively, and with the normally open pushbutton type motor start switches PBA1 through PBA7, respectively. The motor starter relay coils MS1 through MS7 are provided with normally open holding contacts MS1 through MS7, respectively, which are connected in parallel with the start switches PBA1 through PBA7, respectively.

As FIG. 41 further shows, the supply lines AL1 and AL2 from transformer T1 also furnish operating power for a feed clutch solenoid coil CL6 on feed conveyor FC6 and for a solenoid coil CL7 on the discharge conveyor DC7. When feed conveyor selector switch 7SS (shown in automatic position) is set in manual position, each closure of pushbutton switch PB12 energizes coil CR6 and effects a single operation of the feed conveyor FC6, provided that the relay contacts CR2-1, R28, R30 and R29 are closed. Similarly, when discharge conveyor selector switch 9SS (shown in automatic position) is set in manual position, each closure of pushbutton switch PB13 energizes coil CL7 effects a single operation of the discharge conveyor DC7.

Figures 42, 43, 44, 45, 46:
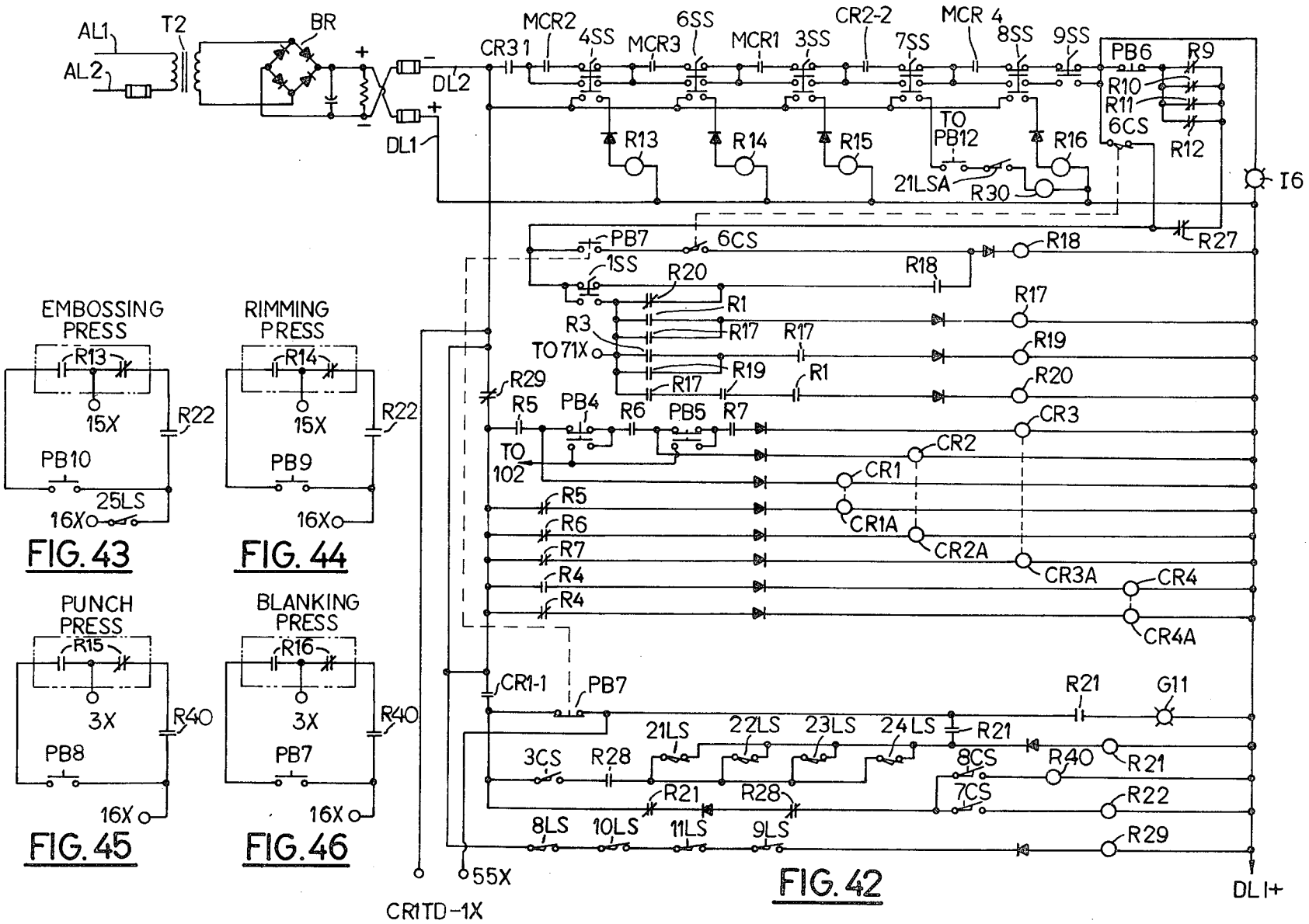

FIGS. 41 and 42 show that the supply lines AL1 and AL2 from transformer T1 also furnish operating power to the primary winding of a 110/24 volt 60 cycle stepdown transformer T2 which has its secondary winding connected through a full-wave bridge-type rectifier BR to supply 24 volt direct current to the d.c. supply lines DL1 and DL2 which energize other relays and contactors, as hereinafter described.

As FIGS. 1 and 42 show, the presses PP1, EP2, RP3 and BP4 are provided with top of stroke SPST NC limit switches 21LS, 22LS, 23LS and 24LS, respectively, and with bottom of stroke SPST NC limit switches 8LS, 10LS, 11LS and 9LS, respectively. No press is able to perform a downstroke until all top of stroke limit switches are closed.

FIGS. 1, 2, 9 through 13, 15, 27, 28, 29, 39, 42 and 47 show that registering device IU5 is provided with a rotating cam switch assembly RCS which comprises eight cam operated single pole single throw normally open cam operated switches designated ICS through 8CS which are operated by cams also designated ICS through 8CS, respectively.

As FIGS. 27 and 39 show rotating cam switch assembly RCS comprises rotating cams ICS through 8CS affixed to and rotatable with a cam shaft CSF. As FIG. 28 best shows, each cam comprises two discs CSA and CSB which are relatively movable to enable adjustment of the length of the cam slot CSL. Cam switch assembly RCS is a known type of apparatus and is available from the Gemco Electric Company of Clawson, Michigan and is available as a type 1980-108-R-SP-X unit and is described in that company's catalog dated February 1973 entitled "Rotating Cam Limit Switches."

A pulley sprocket 191 keyed to counter shaft 128 is connected by a chain 193 to a sprocket 192 keyed to shaft CSF. The shafts 128 and CSF rotate on a 1:1 ratio so that one complete operating cycle of indexing arm 3 is accompanied by one complete operating cycle of rotating cam switch assembly RCS. As FIG. 40 shows, the cam slots or depressions CSL in the cams 1CS and 2CS (which cam slots each subtend an angle of about 30°) are 180° out of phase and the cam slot in cam 7CS, which is in phase with that of cam 2CS, subtends an angle of about 60°, so as to enable cam switch 7CS to remain closed long enough for a complete cycle of embossing and rimming press operation. All of the other cam switches have a cam slot which subtends an angle of about 30°, except 8CS which controls the punching and blanking presses and has a slot which subtends an angle of about 70°.

Cam switch 1CS closes just before indexing arm 3 reaches the starting point of its cycle, i.e., just before it starts its forward stroke, to initiate or enable clutch unit operation and lock unit operation and remains closed for a short period after the forward stroke has begun. Cam switch 2CS closes just before indexing arm 3 reaches the mid-point of its cycle, i.e., just before the end of its forward stroke, to terminate or disable clutch unit and lock unit operations, and remains closed for a short period after the return stroke has begun.

Cam switches 7CS and 8CS also close before indexing arm 3 reaches the midpoint of its cycle and also remain closed for a period after it commences its return stroke and, of course, close and remain closed for a longer period than cam switch 2CS. Switches 7CS and 8CS, respectively, control embossing and rimming press operations and punching and blanking press operation by effecting operation of the relays R22 and R40, respectively.

Cam switch 3CS is timed to close just before cam switches 7CS and 8CS close to perform a press check to insure that all presses are in proper condition or position (i.e., open) before cam switches 7CS and 8CS can initiate the press downstrokes.

Cam switch 4CS closes at the start of the forward stroke of arm 3 to place in readiness a check circuit containing limit switches 12LS thru 19LS, hereinbefore referred to, which insure that the clutch units and lock units of unit IU5 are in appropriate position before other system operations occur.

Figure 47:
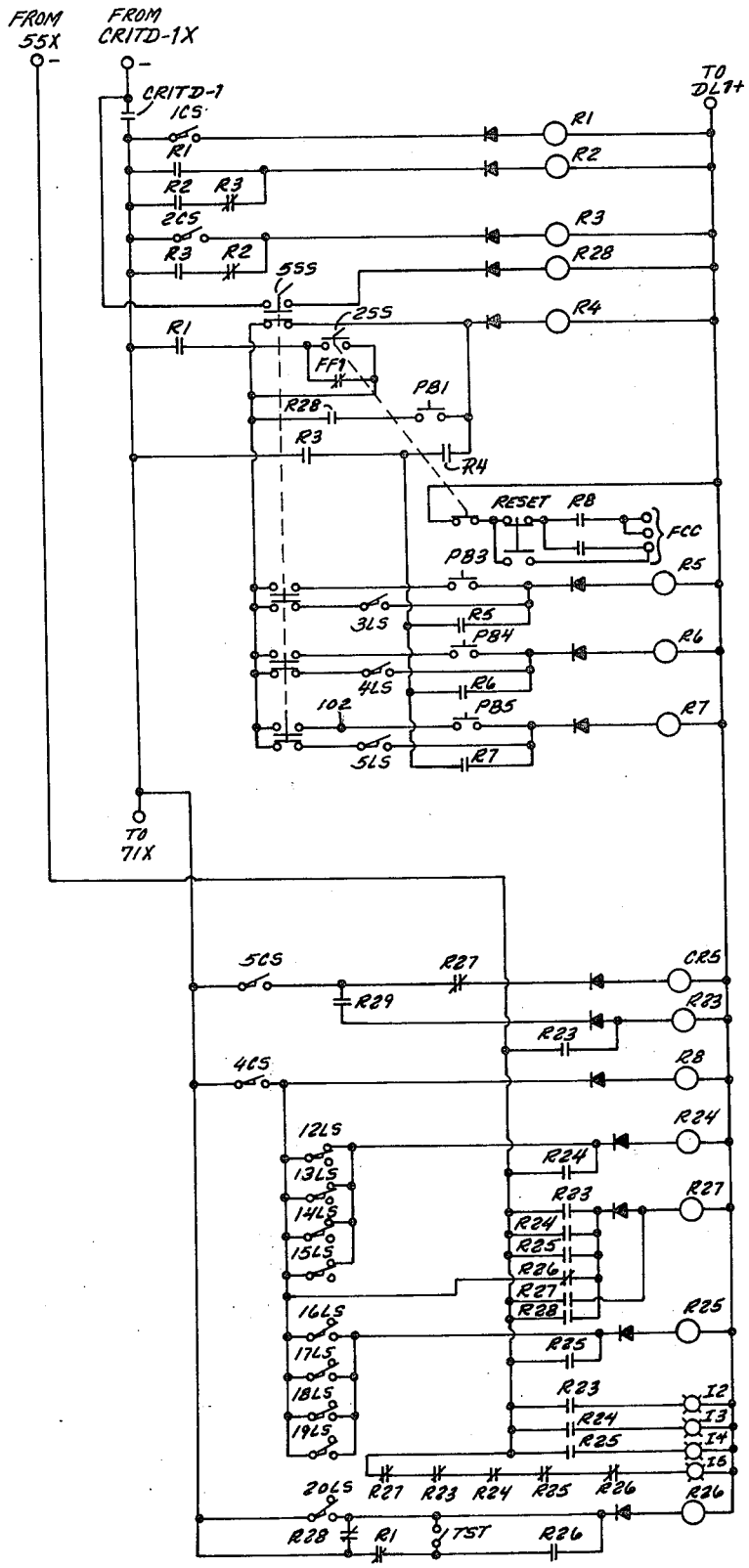

Cam switch 5CS closes after the end of the forward stroke of arm 3 (i.e., just after the mid-point of the indexing unit cycle) to trigger operation of the feed conveyor FC6 and the discharge conveyor DC7 by energizing the feed conveyor relay coil CR5 and the discharge conveyor relay coil R23 (shown in FIG. 47).

Cam switch 6CS closes as the arm 103 approaches its start of stroke position to insure that the arm is in fact in proper position before cam switch 1CS initiates the cycle.

As FIGS. 40, 41, 42, and 47 show, the control system for the numerical registering device, its four associated presses and the conveyors generally comprises the manually operable two-position mode selector switch 5SS which enables operation of the device in the automatic mode or the manual mode. Switch 5SS is shown as positioned in the automatic mode in which the advance of the rings W, X, Y, Z is automatically effected in progressive sequence in response to operation of a rotating cam switch assembly RCS. In its manual mode position, switch 5SS enables each ring W, X, Y, Z to be advanced individually to a desired position by manual operation of the appropriate ring advance pushbutton switches PB1 (for ring W), PB3A (for ring X), PB4A (for ring Y), PB5A (for ring Z). Rotating cam switch assembly RCS, which is effective when operation is in the automatic count mode, comprises a cam switch 1CS to initiate operation of the clutch units and lock units to effect advancement of an appropriate ring or rings and a cam switch 2CS to effect operation of the clutch and lock units to effect locking of the ring or rings which have been advanced and to enable a return stroke of indexing arm 3. Cam switches 7CS and 8CS effect operation of the presses at an appropriate time in the operational cycle of the registering device. The other four cam switches perform the functions hereinbefore described.

Cam switch 1CS closes to energize relay coils R1 and R2 having hereinafter described contacts which operate, as hereinafter described, to enable the ring operated counting switches 3LS, 4LS, 5LS, if an when actuated closed by a respective ring W, X, Y, to operate the counting relays R5, R6, R7, respectively. In the automatic mode, the counting relay R4 operates directly in response to energization of relay coil R1 and closure of its relay contact R1A. In the manual mode, the counting relay R4 operates in response to manual closure of pushbutton switch PB1 (relay contact 28 being closed when manual select relay coil 28 is energized by closure of selector switch contact 5SS1). Operation of the counting relays R4, R5, R6, R7 effects operation of the clutch unit relays CR4, CR1, CR2, CR3, respectively, and the lock unit relays CR4A, CR1A, CR2A, CR3A, in turn, effects operation of the clutch unit solenoid coils S1A, S2A, S3A, S4A, respectively. Operation of the lock unit relays CR4A, CR1A, CR2A, CR3A, in turn, effects operation of the lock unit solenoid coils S1B, S2B, S3B, S4B, respectively. The clutch unit and lock unit solenoid coils, in turn, operate the solenoid valves W-3, X-3, T-3, Z-3 for the clutch units W-1, X-1, Y-1, Z-1 and the lock units W-2, X-2, Y-2, Z-2.

The clutch unit solenoid coils S1A, S2A, S3A, S4A and the lock unit solenoid coils S1B, S2B, S3B, S4B are energizable from the source of 125 volt alternating current comprising supply lines AL1 and AL2. The clutch unit solenoid coils S1A, S2A, S3A, S4A are connected across the lines AL1 and AL2 in series with normally open clutch unit relay contacts CR4, CR1,

CR2, CR3, respectively. The latter contacts are operated by clutch unit relay coils CR4, CR1, CR2, CR3, respectively, which are energizable from a source of 24 volt direct current comprising terminals DL1 and DL2. The lock unit solenoid coils S1B, S2B, S3B, S4B are also connected across the lines AL1 and AL2 in series with normally closed lock unit relay contacts CR4A, CR1A, CR2A, CR3A, respectively. The latter contacts are operated by lock unit relay coils CR4A, CR1A, CR2A, CR3A, respectively, which are energizable from the terminals DL1 and DL2. In practice, it is preferred that a clutch unit relay be physically associated with its corresponding lock unit relay to insure see-saw action and this is indicated by dashed lines in FIG. 15.

The clutch unit relay coil CR3 is connected across terminals DL1 and DL2 in series circuit with a normally open counting relay contact R7A, a (shown closed) ring advance pushbutton contact PB5B, a normally open counting relay contact R6A, a (shown closed) ring advance pushbutton contact PB4B, and a normally open counting relay contact R5A.

The clutch unit relay coil CR2 is connected between terminal DL1 and a point between contacts PB5 B and R6A. The clutch unit relay coil CR1 is connected between terminal DL1 and a point between contacts PB4B and R6A. The remaining relay coils CR1A, CR2A, CR3A, CR4, CR4A are connected across lines DL1 and DL2 in series with the counter relay contacts R5B, R6B, R7B, R4A, R4B, respectively, which are all normally closed contacts, except for contact R4A.

The counting relay coils R4, R5, R6, and R7 are energizable from the direct current terminals DL1 and DL2. More specifically, the counting relay coils R5, R6, R7 are connected between terminals DL1 and DL2 in series with the normally open counting switches 3LS, 4LS, 5LS, hereinbefore described, and the closed contacts 5SS8, 5SS6, 5SS4 of the two-position count mode selector switch 5SS, shown as disposed in the automatic count mode. The counting relay coils R5, R6, R7 are alternately connectable during manual mode operation to terminal DL2 through the normally open manual advance pushbutton switches PB3A, PB4A, PB5A, respectively, which are in series with the open contacts 5SS7, 5SS5, 5SS3, respectively, of count mode selector switch 5SS.

In the automatic mode, the counting relay coil R4 is connected between terminals DL1 and DL2 in series with the normally open relay contact R1A and the closed contact 5SS2 of selector switch 5SS. In the manual mode, coil R4 is connectable in series between terminals DL1 and DL2 through normally open manual counting pushbutton switch PB1 and normally open manual select relay contact 28. The manual select relay coil 28 for operating relay contact 28 is connected between terminals DL1 and DL2 in series with the contact 5SS1 of count mode selector switch 5SS.

One side of relay coils R5, R6, R7 is alternately connectable to terminal DL2, (through normally closed relay contact R3C) through the relay holding contacts R5C, R7C, respectively.

FIG. 42 shows, contact CR31 is an interlock which insures that none of the process controls can become active unless the indexer motor is running. Contact MCR2 is an interlock on the Embossing Motor starter to insure the press is running when 4SS is in "auto". Contact MCR3 is an interlock on the Rimming Motor starter to insure the press is running when 6SS is in "auto" position. Contact MCR1 is an interlock on the Punching Motor starter to insure the press is running when switch 3SS is in the "auto" position. Contact CR22 is an interlock on the feed conveyor which insures the motor is running when 7SS is in the "auto" position. Contact MCR4 is an interlock on the Blanking Motor starter to insure the press is running when 8SS is in the "auto" position.

The contacts CR31, CR21 and CR1-1 are controlled by the coils CR31, CR21 and CR11, respectively, shown in FIG. 41. The coil CPA protects the contacts R18 from arcing. The terminals FFC shown in FIG. 47 are understood to be input terminals operable to give a double feed of web W per single count when two consecutive plates bear the same number. CR21 is an interlock relay used in conjunction with relay MS6 on the feed conveyor motor. CR31 is an interlock relay used in conjunction with relay MS5 on the indexing motor. A test switch TST is provided as shown in FIG. 47 to determine if the reed relay has become stuck or locked in accidentally, as may possibly happen.

The contact CRITD-1 allows a time delay to occur between the time when the process start button is depressed and the time when the indexer starts counting. More specifically, this time interval allows the presses to stroke once or twice to insure that they are operating properly before the actual manufacturing sequence commences.

Referring to FIGS. 43, 44, 45, and 46, it is to be understood that each pair of terminals 15X and 16X and each pair of terminals 3X and 16X is connected in series circuit with a source of 115 volt alternating current and the press ram solenoid for a respective press, and press operation, therefore, is determined either by operation of the pushbutton switches PB7, PB8, PB9, PB10 or by closure of the relay contacts R22, R40.

OPERATION

The simplified control circuit shown in FIG. 40 operates as follows. Assume that the lines AL1 and AL2 and DL1 and DL2 are energized and that all contacts are initially in the condition shown in FIG. 40. Further assume that indexing arm 3 is undergoing its oscillating motion as hereinbefore described. Also assume that the clutch unit relay coils CR1, CR2, CR3, CR4 are de-energized (because the relay contacts R4A, R5A, R6A, R7A are open) and that the lock unit relay coils CR1A, CR2A, CR3A, CR4A are energized (because the relay contacts R4B, R5B, R6B, R7B are closed).

If manual operation is desired, selector switch 5SS is moved to its manual position thereby closing its contacts 5SS1, 5SS3, 5SS5, 5SS7 and opening its contacts 5SS2, 5SS4, 5SS6, 5SS8. In this condition, manual closure of the pushbutton switches PB1, PB3A, PB4A or PB5A effects energization of the relay coils R4, R5, R6 or R7, respectively, and this in turn, effects energization of the clutch unit relay coils CR4, CR1, CR2, or CR3, respectively, and de-energization of the lock unit relay coils CR4A, CR1A, CR2A or CR3A, respectively. Energization of a clutch unit relay coil and de-energization of its corresponding lock unit relay coil effects energization of a corresponding clutch unit solenoid coil (S1A, S2A, S3A, S4A) and deenergization of a corresponding lock unit solenoid coil (S1B, S2B, S3B, S4B) and this, in turn, effects operation of a corresponnding solenoid valve W-3, X-3, Y-3, Z-3 for the rings W, X, Y, Z, as hereinbefore explained.

If automatic operation is desired, selector switch 5SS is moved to its automatic position shown in FIG. 40 thereby closing its contacts 5SS2, 5SS4, 5SS6, 5SS8 and opening its contacts 5SS1, 5SS3, 5SS5, 5SS7. In this condition of switch 5SS, the manual pushbutton switches PB1, PB3A, PB4A, PB5A are rendered ineffective and ring advance depends on the operation of cam switches 1CS and 2CS and the counting switches 3LS, 4LS, 5LS. More specifically, as cam 1CS rotates to close cam switch 1CS (as arm 3 approaches its start of advance stroke position), relay coil R1 is energized and closes its contact R1A (to energize relay coil R4) and closes its contact R1B (to energize relay coil R2).

When relay coil R4 is energized, it closes its relay contact R4A (to energize clutch unit relay coil CR4 and thereby enable ring W to advance) and opens its relay contact R4B (to de-energize lock unit relay coil CR4A and thereby unlock ring W so it can advance). When relay coil R2 is energized it closes its relay contact R2A (to hold coil R2 energized) and opens its relay contact R2B (to insure de-energization of relay coil R3). As cam 1CS rotates to a position wherein can switch 1CS reopens, the indexing arm 103 has advanced the ring W and the clutch pin 158 is withdrawn, whereupon the lock pin 158' is inserted in a hole — in ring W. When cam 2CS rotates to a position wherein it closes cam switch 2CS (i.e., as arm 103 approaches the end of the advance stroke), relay coil R3 is energized and opens its contact R3A (to insure de-energization of relay coil R2), closes its holding contact R3B, and opens its relay contact R3C (to disable the counting switches 3LS, 4LS, 5LS). This process is repeated until, during the tenth advancing step of ring W, the counting switch 3LS closes to energize relay coil R5.

When relay coil R5 is energized it closes its holding contact R5C, closes its contact R5A (to energize clutch unit solenoid relay coil CR1) and opens its contact R5B (to de-energize locking unit solenoid relay coil CR1A). The relay coils CR1 and CR1A then operate respectively to close the relay contact CR1 and open the relay contact CR1A, whereby ring X advances. Cam switches 1CS and 2CS operate repeatedly as hereinbefore described and ring X is repeatedly advanced until, during its tenth step, the counting switch 4CS closes to energize relay coil R6.

When relay coil R6 is energized it closes its holding contact R6C, closes its contact R6A (to energize clutch unit solenoid relay coil CR2) and opens its contact R6B (to de-energize locking unit solenoid relay coil CR2A). The relay coils CR2 and CR2A then operate respectively to close the relay contacts CR2 and open the relay contact CR2A, whereby ring Y is advanced. Cam switches 1CS and 2CS operate repeatedly as hereinbefore described and ring Y is repeatedly advanced until, during its tenth step, the counting switch 5CS closes to energize relay coil R7.

When relay coil R7 is energized it closes its holding contact R7C, closes its contact R7A (to energize clutch unit solenoid relay coil CR3) and opens its contact R7B (to de-energize locking unit solenoid relay coil CR3A). The relay coils CR3 and CR3A then operate respectively to close the relay contact CR3 and open the relay contact CR3A, whereby ring Z advances. Cam switches 1CS and 2CS operate repeatedly as hereinbefore described and ring Z is repeatedly advanced until, after its tenth step, and after the rings W, X, Y have rotated a sufficient number of times to exhaust the combination of digits available (i.e., 9999), the registering device is stopped and the prefix numerals or letters are changed to enable a new series of numbers to be run.

As is apparent from FIGS. 41 through 47, the press limit switches, the conveyor limit switches, the limit switches associated with the clutch units and the lock units, and all selector switches must be in proper position to enable operation of the system in the automatic mode. Assuming that this is the case, each operation of indexing unit IU5 is accompanied by an operation of feed conveyor FC6 and one step of web advance and is followed by one operation of all the presses.

It should also be noted that FIG. 40 is a simplified version of the circuiting shown in FIGS. 41 through 47 and that certain circuit elements have been deleted from FIG. 40 to simplify understanding of the operation of the invention. However, the more complete circuiting shown in FIGS. 41 through 47 discloses the more complete embodiment of applicants' invention.

We claim:

1. Apparatus for forming discrete differently embossed segments from a continuous web of sheet material movable through said apparatus in a predetermined direction comprising:

a punching press for providing at least one mounting hole in each segment;

an embossing press;

embossing means for cooperation with said embossing press and having a support frame and an assembly of embossing elements in the form of relatively rotatable rings on said support frame, each ring having a series of embossing characters on the obverse side and a series of pin engaging means on the converse side;

indexing means for moving said rings at successive intervals of time, said indexing means comprising an indexing arm swingable through a ring advance stroke and a return stroke, clutch units on said indexing arm and having clutch pins extendable to engage said pin engaging means on said rings to advance said rings in a predetermined order at successive intervals of time, said indexing means further comprising lock units on said support frame having lock pins extendable to engage said pin engaging means and prevent rotation of said rings;

a rimming press for forming web advancement means in said web;

a blanking press for severing segments from said web;

a feed conveyor spaced from said embossing press in said predetermined direction and located between said rimming press and said blanking press for engagement with said web advancement means to draw said web in stages through said presses;

each of said presses having an open position and a closed position;

independently operable drive means for each of said presses, for said indexing means and for said feed conveyor; and control means for effecting operation of each said drive means and responsive to the positions of said presses and of said indexing means to enable operation of said presses, said indexing means and said feed conveyor in a predetermined sequence;

said control means comprising cam switch means responsive to movement of said indexing arm for effecting operation of said feed conveyor to move said web during intervals of time while any of said rings is being rotated, for effecting operation of said presses during intervals of time while said web and rings are stationary, for effecting extension of said clutch pins and retraction of said lock pins in predetermined order to enable rotation of said rings, and to effect retraction of said clutch pins and extension of said lock pins to prevent ring rotation;

said control means further comprising limit switches on said presses to prevent operation of said presses, feed conveyor and indexing means unless said presses are in open position.

2. Apparatus according to claim 1 wherein said control means further includes counting switch actuator means on each of said rings and counting switch means on said support frame actuatable by said counting switch actuator means so as to be responsive to ring position to effect operation of said clutch units and said lock units in predetermined sequence to enable said indexing arm to effect rotation of said rings in a predetermined sequence.

3. Apparatus according to claim 1 wherein said control means further includes limit switch means responsive to the position of said clutch pins and said lock pins to prevent said cam switch means from enabling operation of said presses and said feed conveyor until predetermined clutch pins are retracted and predetermined lock pins are extended.

4. Apparatus according to claim 3 wherein said control means is selectively operable in either an automatic mode to carry out at least one cycle of operation or a manual mode, said control means being operable in said automatic mode for operating said feed conveyor to move said web during intervals of time when said indexing means is being operated to change said embossing element and when said presses are open and for operating all of said presses when said web and said embossing element are stationary, said control means being operable in said manual mode to enable independent operation of said feed conveyor to advance said web and to enable independent operation of said indexing means to change said embossing element.

5. Apparatus according to claim 4 including counting means for effecting registration of a count and wherein said control means comprises counting switches responsive to movement of said rings when said control means are in said automatic mode to effect automatic continuous cycles of operation and to effect registration of a count on said counting means for each cycle of operation.

6. Apparatus according to claim 5 wherein said control means further comprises count selector means selectively operable in either of two counting modes to effect an embossing element change and registration of a single count in one of said counting modes for each step of web advance and to effect an embossing element change and registration of a single count in the other of said counting modes for each two steps of web advance.

* * * * *